US005849052A

United States Patent [19]

Barber, Jr.

[11] Patent Number: 5,849,052

[45] Date of Patent: Dec. 15, 1998

[54] ABRASIVE ARTICLE HAVING A BOND SYSTEM COMPRISING A POLYSILOXANE

[75] Inventor: Loren L. Barber, Jr., Lake Elmo, Minn.

[73] Assignee: Minnesota Mining and Manufacturing Company, St. Paul, Minn.

[21] Appl. No.: 762,032

[22] Filed: Dec. 9, 1996

Related U.S. Application Data

[63] Continuation of Ser. No. 430,477, Apr. 28, 1995, abandoned.

[51] Int. Cl.[6] ..... B24D 3/02

[52] U.S. Cl. ..... 51/298; 51/306; 428/370; 428/373; 428/374; 428/391

[58] Field of Search ..... 51/294–298; 528/14, 528/25, 27; 552/465; 428/370, 373, 374, 391

[56] References Cited

U.S. PATENT DOCUMENTS

| | | | |
|---|---|---|---|
| 3,041,156 | 6/1962 | Rowse et al. | 51/298 |
| 3,252,775 | 5/1966 | Tocci-Guilbert | 51/296 |
| 3,379,659 | 4/1968 | Murphy | 260/2.5 |
| 3,425,967 | 2/1969 | Modic | 260/2.5 |
| 3,502,453 | 3/1970 | Baratto | 51/295 |
| 3,528,788 | 9/1970 | Seal | 51/295 |
| 3,624,010 | 11/1971 | Holdstock | 260/2.5 |
| 3,982,359 | 9/1976 | Elbel et al. | 51/295 |
| 4,128,972 | 12/1978 | Charvat | 51/298 |
| 4,150,955 | 4/1979 | Samuelson | 51/298 |
| 4,162,900 | 7/1979 | Judd | 51/298 |
| 4,250,290 | 2/1981 | Petersen | 528/14 |
| 4,307,544 | 12/1981 | Balz | 51/163.2 |
| 4,842,619 | 6/1989 | Fritz et al. | 51/295 |
| 4,849,564 | 7/1989 | Shimizu et al. | 524/114 |
| 4,936,057 | 6/1990 | Rhoades | 51/317 |
| 4,974,373 | 12/1990 | Nawashima et al. | 51/295 |
| 4,997,461 | 3/1991 | Markhoff-Matheny | 51/298 |
| 5,042,991 | 8/1991 | Kunz et al. | 51/307 |
| 5,089,330 | 2/1992 | Sato et al. | 428/323 |
| 5,213,589 | 5/1993 | Ronning et al. | 51/293 |
| 5,306,319 | 4/1994 | Krishnan et al. | 51/298 |
| 5,427,595 | 6/1995 | Pihl et al. | 51/298 |
| 5,427,854 | 6/1995 | Goodrich et al. | 51/298 |
| 5,435,816 | 7/1995 | Spurgeon et al. | 51/298 |
| 5,443,906 | 8/1995 | Pihl et al. | 428/370 |
| 5,460,883 | 10/1995 | Barber, Jr. et al. | 51/298 |
| 5,491,025 | 2/1996 | Pihl et al. | 51/298 |

FOREIGN PATENT DOCUMENTS

| | | | |
|---|---|---|---|
| 1 258 182 | 9/1984 | Canada | C09C 1/68 |
| 0 387 056 A3 | 9/1990 | European Pat. Off. | A46D 1/00 |
| 1.591.125 | 5/1970 | France . | |
| 60-067060 | 4/1985 | Japan . | |
| 60-186376 | 9/1985 | Japan . | |
| 3-013335 | 1/1991 | Japan . | |
| 3-213275 | 9/1991 | Japan . | |
| 5-339877 | 12/1993 | Japan . | |
| 6-220151 | 8/1994 | Japan . | |
| 62-218666 | 8/1994 | Japan . | |
| 408 764 | 8/1974 | U.S.S.R. . | |
| WO 93/24272 | 9/1993 | WIPO . | |
| WO 93/24272 | 12/1993 | WIPO | B24B 1/00 |
| WO 96/01721 | 1/1996 | WIPO | B24D 3/34 |

OTHER PUBLICATIONS

Dow Corning Silicone Product Literature: "Polymer Melt Additives for Textile Applications", Dow Corning Corporation, 1992.

M.F. Vallat, P. Ziegler, P. Vondracek and J. Schultz, "Adhesion of Styrene–Butadiene and Silicone Elastomers to Rigid Substrates at Quasi–Equilibrium", The Journal of Adhesion, pp. 95–103, Sep. 1991.

Lawrence R. Waelde, Jerry H. Willner, John W. Du, and Emil J. Vyskocil, "Silicone Additives for High–Solids Polyester–Melamine Coatings", Journal of Coatings Technology, pp. 107–112, vol. 66, No. 836, Sep. 1994.

Dr. Werner Spratte, Dr. Georg Feldmann–Krane and Wernfried Heilen, "Modern Silicone Additives in the Paint Industry", Polymers Paint Colour Journal, pp. 12–13, vol. 183, No. 4321, Jan. 13/27, 1993.

"Release Agents" John Wiley & Sons, *Encyclopedia of Polymer Science and Engineering*, pp. 411–421, vol. 14, 1988.

"Silicones", John Wiley & Sons, *Encyclopedia of Polymer Science and Engineering*, vol. 15, 1989, Table of Contents.

Silicones Chemistry and Technology, 1991 Table of Contents.

"Silicones", John Wiley & Sons, *Encyclopedia of Polymer Science and Engineering*, p. 259, lines 27–30, vol. 15, 1989 (no month).

*Primary Examiner*—Deborah Jones

*Attorney, Agent, or Firm*—Doreen S. L. Gwin; Paul W. Busse

[57] ABSTRACT

An abrasive article comprising (a) a plurality of abrasive particles and (b) a bond system which adheres the plurality of abrasive particles, the bond system comprising a binder and a polysiloxane of formula (A):

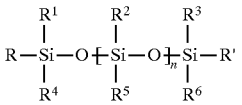

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

41 Claims, No Drawings

ABRASIVE ARTICLE HAVING A BOND SYSTEM COMPRISING A POLYSILOXANE

This is a continuation of application Ser. No. 08/430,477 filed Apr. 28, 1995 now abandoned.

FIELD OF THE INVENTION

This invention relates to abrasive articles having a bond system comprising a polysiloxane, particularly abrasive articles such as abrasive filaments, products including abrasive filaments, coated abrasive articles, nonwoven abrasive articles, and bonded abrasive articles.

BACKGROUND OF THE INVENTION

The practice of incorporating lubricants into both thermoplastic compositions and abrasive compositions is well known. Lubricants for thermoplastic compositions are generally classified as either internal lubricants or external lubricants [c.f., *Encyclopedia of Polymer Science and Engineering,* 14:411–421, John Wiley & Sons, New York. 1988]. Internal lubricants are generally considered to be processing aids that, while sometimes imparting modifications of the physical properties of the finished articles, are employed to increase productivity and throughput of thermoplastic materials in, for example, extrusion processes, by modification of viscous flow properties. External lubricants on the other hand are employed to impart a desirable property to the finished article regardless of processing advantages.

Various lubricants have been employed in the manufacture and use of abrasive articles. For example, U.S. Pat. No. 1,325,503 describes the incorporation of wax, grease, oil, and fats into grinding wheels. Abrasive articles comprising encapsulated lubricants have been described in U.S. Pat. No. 3,502,453. In addition, metal stearates, stearamides, molybdenum disulfide, graphite, silanes, and polytetrafluoroethylene have been used in various abrasive compositions. For example, U.S. Pat. No. 4,609,380 discloses metal stearates and U.S. Pat. No. 5,306,319 discloses metal stearates and molybdenum disulfide.

In addition, WO 93/24272 discloses a method of shaping metal using a tool in a friction-inducing manner and in the presence of an anti-lubrication agent which can include polysiloxanes, preferably medium molecular weight poly (dimethyl)siloxanes. WO 93/24272 discloses that the polysiloxane can be applied to the tool/workpiece interface or impregnated into a grinding wheel or abrasive stone, as porous materials, along with a catalyst and baked. The method of WO 93/24272 is disclosed as being applicable to conventional abrading, de-burring and finishing tools used in the industry such as abrasive-loaded nylon filaments, nonwoven abrasive materials, coated abrasive belts, flap wheels, and cloth buffs, with abrasive liquid or bar compounds.

U.S. Pat. No. 5,213,589 discloses abrasive articles having a coating which covers at least a portion of the abrasive surface of the abrasive article and which includes a crosslinked siloxane.

In addition, silicone materials have been known for various purposes including reinforcing agents and processing aids. For example, U.S. Pat. No. 4,849,564 discloses the use of a silicone rubber as a reinforcing agent for polymeric materials including elastomers and resins. The silicone rubber is disclosed as containing an epoxy compound having at least one unsaturated hydrocarbon group in each molecule and as being formed from a curable liquid silicon rubber composition comprising a diorganopolysiloxane having at least two silicon-bonded hydroxyl groups per molecule, an organohydrogenpolysilocane having at least two silicon-bonded hydrogen atoms per molecule, and a curing agent.

Additionally, particular polysiloxane compounds are known. Dow Corning Corporation Publication 25-339-92 entitled "Polymer Melt Additives for Textile Applications", 1992, discloses high viscosity silicone fluids or high-molecular weight silicone gums, suitable for blending with thermoplastic polymers, which can add valuable silicone characteristics without altering chemical structure and with minimal change to mechanical properties. The benefits disclosed include internal lubrication and mold release, better mold filling and extrusion at lower temperatures and pressures and faster throughput, increased surface lubricity, antiblocking properties, and increased mar and abrasion resistance. This publication discloses that there are other organoreactive fluids that can be used for polymer modification and that organoreactive fluids are siloxanes modified to include predictable areas of organic reactivity; these fluids are disclosed as having the benefits of durable silicone attachment and retention of base resin properties.

An article by J. W. White et al. entitled "New Silicone Modifiers for Improved Physical Properties and Processing of Thermoplastics and Thermoset Resins" published by Dow Corning Corporation discloses that silicone fluids and emulsions are widely used in the plastics industry as external release agents but that silicone fluids dispersed in a thermoplastic matrix can also function as internal release agents, lubricants, and process aids. The article discloses that blends of silicone gum and thermoplastic resin can result in a variety of processing advantages and polymer property improvements including built-in mold release, internal lubrication, reduced cycle times, improved wear resistance, reduced warpage and rejects, and increased load speed capabilities.

Silicone gums are widely used as a starting material in the preparation of heat-cured silicone rubber compositions. *Encyclopedia of Polymer Science and Engineering,* 15:204–308, John Wiley & Sons, New York. 1989, When compounded with fillers, reinforcing agents, and other additives and subjected to thermally-initiated crosslinking reactions, useful elastomeric articles can be manufactured.

SUMMARY OF THE INVENTION

While certain lubricants, as noted above, are known to be useful for abrasive articles and while a wide variety of silicone materials are known, for example, to be useful internal lubricants and/or to provide decreased wear upon blending, it has now been discovered in the present invention that certain polysiloxanes are particularly efficacious in improving performance of abrasive articles and particularly, abrasive filaments. The present invention is directed to abrasive articles containing a polysiloxane in their bond system which results in a cutting performance which is maintained or increased while wear is dramatically decreased, resulting in improved abrasive efficiency. In fact, typically, abrasive articles exhibiting less wear also achieve less cut or, to state this occurrence in another way, when better cut is achieved, wear is greater. In the present invention, however, the cut is maintained or increased, yet the wear decreases.

Exemplary abrasive articles include abrasive filaments, abrasive products comprising abrasive filaments, coated abrasives, nonwoven abrasives, bonded abrasives which include abrasive wheels, vitrified grinding wheels and the like, and molded abrasive products which include molded abrasive brushes. The phrase "coated abrasive" typically refers to an abrasive article comprising a plurality of abrasive particles adhered to a backing; the phrase "nonwoven abrasive" typically refers to an abrasive article having a plurality of abrasive particles adhered to and within a web of fibers; and the phrase "bonded abrasive" typically refers to an abrasive article in which a plurality of abrasive particles are adhered together in a shaped mass by a bond system. The phrase "molded abrasive product" refers to an abrasive product made by injection molding a moldable polymer and abrasive particles.

In particular, the present invention relates to an abrasive article comprising (a) a plurality of abrasive particles and (b) a bond system which adheres the plurality of abrasive particles, the bond system comprising a binder and a polysiloxane.

In one embodiment, the present invention relates to a coated abrasive comprising (a) a backing having a major surface, (b) a plurality of abrasive particles, and (c) a bond system which adheres the plurality of abrasive particles to the major surface of the backing, the bond system comprising a binder and a polysiloxane.

In another embodiment, the present invention relates to a bonded abrasive article comprising (a) a plurality of abrasive particles and (b) a bond system which bonds the plurality of abrasive particles into a shaped mass, the bond system comprising a binder and a polysiloxane.

In yet another embodiment, the present invention relates to a nonwoven abrasive article having at least one major surface and an interior region, the nonwoven abrasive article comprising (a) an open lofty web of organic fibers, (b) a plurality of abrasive particles, and (c) a bond system which adheres the plurality of abrasive particles to the open lofty web, the bond system comprising a binder and a polysiloxane.

The present invention also relates to an abrasive filament comprising (a) a first elongate filament component having a continuous surface throughout its length and being comprised of a first hardened organic polymeric material; and (b) a second elongate filament component coterminous with the first elongate filament component comprised of a second hardened organic polymeric material in melt fusion adherent contact with the first elongate filament component along the continuous surface, the second hardened organic polymeric material being the same or different than the first hardened organic polymeric material, wherein at least one of the first and second hardened organic polymeric materials comprises abrasive particles dispersed and adhered therein and at least one of the first and second hardened organic polymeric materials comprises a polysiloxane.

In addition, the present invention relates to a composite abrasive filament comprising at least one preformed core at least partially coated with a hardened organic polymeric material comprising (a) abrasive particles, the abrasive particles dispersed and adhered in the hardened organic polymeric material, and (b) a polysiloxane.

In yet another embodiment, the present invention relates to a structured abrasive article comprising a backing having a major surface and a plurality of abrasive composites adhered to the major surface of the backing, each abrasive composite comprising a plurality of abrasive particles and a bond system comprising a binder and a polysiloxane.

The present invention also relates to a monofilament comprising a hardened organic polymeric material, a plurality of abrasive particles, and a polysiloxane.

DETAILED DESCRIPTION OF THE INVENTION

As described above, abrasive articles of the present invention comprise a bond system which comprises a silicone material. Elements of the present invention are described below.

Polysiloxane Material

A polysiloxane of the present invention comprises a polysiloxane of formula (A):

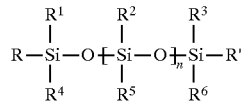

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater. Preferably, n is 1000 or greater, more preferably n ranges from 1000 to 20,000, most preferably n ranges from 1,000 to 15,000. Preferably, R, R', $R^1$, $R^2$, $R^3$, $R^4$, $R^5$, and $R^6$ are individually alkyl, more preferably methyl.

Accordingly, the molecular weight of a polysiloxane of the present invention is generally at least about 35,000, preferably at least about 70,000, more preferably about 70,000 to about 1,400,000, most preferably about 70,000 to 1,000,000. A polysiloxane having a molecular weight substantially lower than about 35,000 may contribute beneficially, although such lower-viscosity polysiloxanes may migrate more quickly to the surface of an abrasive composition, thereby possibly offering less performance improvement later in the useful life of the abrasive composition.

A polysiloxane of the present invention is an uncrosslinked polysiloxane. The term "uncrosslinked" as used herein with respect to a polysiloxane of the present invention means that the polysiloxane is not crosslinked but can include both linear and branched polysiloxanes.

Generally, a polysiloxane of the present invention resembles a deformable solid but may have other consistencies.

A preferred polysiloxane is a polydimethylsiloxane of formula (B):

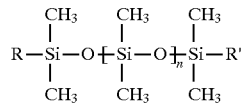

(B)

wherein R and R' may be the same or different and can be an alkyl, vinyl, chloroalkyl, aminoalkyl, epoxy, fluororalkyl, chloro, fluoro, or hydroxy, preferably, alkyl, more preferably, methyl, and n is 500 or greater, preferably n is 1000 or greater, more preferably n ranges from 1000 to 20,000, most preferably n ranges from 1,000 to 15,000. An example of a particularly preferred polydimethylsiloxane is a polydimethylsiloxane according to formula (B) wherein R and R' are methyl and the weight-average molecular weight of this polysiloxane is $5.83\times10^5$ and the number average molecular weight of this polysiloxane is $2.84\times10^5$ such that n is approximately 7773.

A polysiloxane of the present invention may be incorporated into a bond system of an abrasive article at a weight percent, based on the weight percent of the bond system (for example, total weight percent of organic polymeric material), ranging from at least about 1%, typically 1 to 20%, preferably 2 to 10%, more preferably 2 to 6%, most preferably 4 to 6%.

Polysiloxanes are available in many different forms, e.g., as the compound itself or as a concentrate, for example, plastic, i.e., polymer, pellets. Example of the polymers into which the polysiloxane can be concentrated, i.e., compounded, include polypropylene, polyethylene, polystyrene, polyamides, polyacetal, acrylonitrile-butadiene-styrene (ABS), and polyester elastomer, all of which are commercially available, for example, a polyamide available from E.I. Du Pont de Nemours Company, Wilmington, Del. under the trade designation "Zytel 101"; a polyester elastomer available from E.I. Du Pont de Nemours Company, Wilmington, Del. under the trade designation "Hytrel 6356"; and a polypropylene available from Exxon Chemical Company, Houston, Tex. under the trade designation "Escorene 3445". Typically, commercially available concentrates may contain a polysiloxane at a weight percent ranging from 40 to 50; however, any weight percent is acceptable for purposes of the invention as long as the desired weight percent in the final product can be achieved. When the polysiloxane is available in other than concentrate form, it is necessary to, for example, compound the polysiloxane into a polymer which is compatible with the environment in which it is to be used. For example, if the polysiloxane is to be used in a thermoplastic elastomeric filament, the polysiloxane can be compounded with the thermoplastic elastomer in a weight percent as discussed above. Alternatively, if the polysiloxane is to be used in a coated, structured, bonded, or nonwoven abrasive article, the polysiloxane can be incorporated into the bond system without being compounded into a concentrate. For example, the polysiloxane can be dissolved into a solvent and combined with, for example, a resin used in the desired abrasive article.

A polysiloxane of the present invention may be prepared by methods known by those skilled in the art of silicone polymer synthesis. For example, difunctional monomers, such as dimethyldichlorosilane, may be polymerized under appropriate conditions to form linear polysiloxane polymers. Monofunctional reactants such as water or trimethylsilylchloride can be included to terminate the polymerization reaction and control the degree of polymerization and, thus, the resulting molecular weight of the polymer chains. Such monofunctional reactants, also known as "chainstoppers", can determine the nature and functionality of the endgroups of the polysiloxane. When water is employed as a chainstopper, the resulting end group will be a silanol group (Si—OH). In addition, a chainstopper such as a trimethylsiloxy compound of formula (C) can be used:

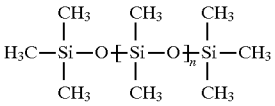

(C)

wherein n ranges from 3 or higher, preferably 3 to 7, more preferably 3 to 5, and most preferably 3. Such a chainstopper typically results in trimethylsiloxy-terminated chains.

Exemplary preparation methods include the following examples of a batch method and an continuous method.

Batch Method

Siloxane cyclic monomers such as dimethyl tetramer can be charged to a polymerization vessel and dried by distillation or by refluxing the siloxane vapors through a molecular sieve column. The temperature of the dry monomers can then adjusted to about 155° C. and a potassium hydroxide polymerization catalyst can be added in the form of a ground slurry in methyl tetramer to give a potassium hydroxide concentration of approximately 20 ppm. The polymerization reaction can be allowed to proceed with agitation until a highly viscous polymer can be obtained, typically within 30±10 minutes. Then, water can be added as a chainstopper to the polymer to restrict further viscosity increase and agitation can be continued at about 155° C. Three more water additions can be made at approximately 25 minute intervals, and agitation can be continued for approximately 30 minutes after the last water addition.

The polymer can then be sampled and tested for completion of the polymerization reaction and to determine the viscosity of the polymer. The potassium hydroxide catalyst can be neutralized by adding an equal molar quantity of phosphoric acid and agitating for 1 to 1.5 hours to complete the neutralization reaction. The polymer can be sampled again and tested for acid/base concentration. The stability of the polymer to elevated temperatures can also be tested. Finally, the polymer can be stripped of unreacted monomers by distillation at pressures of 5 to 10 mm Hg and a temperature of approximately 160° C. The resultant silanol-stopped siloxane polymer made by the above reaction may have a viscosity of approximately 3500 cs at 25° C. and may contain less than approximately 2% unreacted monomer.

Continuous Method

A continuous method can be employed to prepare a polysiloxane as described in U.S. Pat. No. 4,250,290 to Petersen. For example, a dimethyl cyclic siloxane monomer can be partially degassed by heating the monomer to a temperature of at least 140° C. but not higher than the boiling point of the monomer and the gases can then be separated from the monomer in a gas-liquid separating chamber at atmospheric pressure. The degassed monomers can then be pumped at a desired constant rate through a heat exchanger in order to raise the temperature of the degassed monomers to a temperature which is compatible with residence time in the polymerization reactor. Suitable temperatures can range from approximately 160° C. to approximately 200° C. The hot monomer can then be mixed with a basic catalyst in a mechanically driven in-line mixer.

Suitable basic catalysts include cesium hydroxide, potassium hydroxide, sodium hydroxide, lithium hydroxide and their analogues cesium silanolate, potassium silanolate, sodium silanolate and lithium silanolate. These various catalyzing agents have different relative reactivities with respect to the present polymerization process. For example, sodium hydroxide is a weak base and will catalyze the polymerization relatively more slowly than other basic catalysts, and therefore, the reaction may take longer at any given temperature. On the other hand, cesium hydroxide reacts very quickly but the polymerization reaction could run to completion before there is any opportunity to control the viscosity of the product or the efficiency of the process by the practice of the present invention. Thus, cesium hydroxide may be an effective catalyst when a strong base is required, for example, when the temperature of the polymerization reaction zone is low. A preferred basic catalyst is potassium silanolate which is an active form of potassium hydroxide and which is also very soluble in a monomer solution such as octamethyltetrasiloxane. The relatively great solubility of this catalyst in the starting material is a very advantageous characteristic which greatly increases the efficiency of this continuous polymerization process. If a less soluble catalyst such as potassium hydroxide were utilized, it may be necessary to provide an agitated chamber having sufficient residence time to dissolve the potassium hydroxide by reaction with the siloxane monomer to form potassium silanolate. In this method, it is preferred that the potassium silanolate be prepared beforehand in sufficient quantities so that it may be continuously added to the polymerization process.

The potassium silanolate can then be pumped into the in-line mixer by a constant rate pump. An in-line mixer is preferred but not essential and serves the primary purpose of providing back-mixing at the start of the process so that the catalyst monomer solution has a more uniformly consistent composition with time. A secondary benefit of the in-line mixer is that it may ensure rapid and uniform solution of the potassium silanolate catalyst in the monomer.

The hot catalyzed monomer can then be passed into a static mixer which is kept at an essentially constant temperature of approximately 160° C. to approximately 200° C. and, preferably, approximately 180° C. to approximately 190° C. A pressure slightly greater than the vapor pressure of water at the polymerization temperature can be maintained within the static mixer. Typically, 170 psi (1172 kilopascals) gauge pressure for a polymerization temperature of 190° C. is suitable.

The volume of the static mixer may be chosen so that sufficient residence time can be provided in order to obtain the desired degree of polymerization and so that the polymerization reaction can proceed continuously at a predetermined rate. Typically, a polymer containing less than 16% of the unreacted monomer is obtained. It is recognized, however, that when the monomer is dimethyl cyclic siloxane the equilibrium monomer content is approximately 12%.

The mixing efficiency of the static mixer can be maintained by controlling the viscosity increase of the polymeric product. The viscosity can be controlled by an early introduction of a chainstopping agent. For a silanol-stopped polymer, a water chainstopper can be pumped into the polymerizer at a rate such that a polymer of a desired average molecular weight and viscosity will be produced. An amount of water ranging from at least about 100 ppm water up to about 500 ppm water can then be added at the front section of the polymerizer to provide sufficient chainstopping activity to limit the viscosity of the polymer formed at this point and, more particularly, to limit the viscosity of polymer formed early in the polymerization process.

For the manufacture of polymers requiring more than the above 100 to 500 ppm water chainstopper, a second stream of water can then be introduced at a controlled flow rate at a point sufficiently upstream from the end of the polymerizer section to provide for complete mixing of the water with the polymer, using an approximately two minutes of residence time for reaction of the water with the polymer. The viscosity of the silanol end- stopped polymer can be controlled by the proportion of water to polymer, with the water proportion being the sum of the two streams. The polymer can then be passed into a short length of small diameter static mixer wherein a suitable neutralizing agent is introduced.

The neutralizing agents may be any mild acids effective for neutralizing the basic catalyst. Such neutralizing agents can include phosphoric acid, trischlorethylphosphite, or more preferably, silyl phosphate which is particularly effective because it is quite soluble in siloxane polymers and allows for rapid neutralization.

Silyl phosphate may be pumped into the static mixer to neutralize the potassium silanolate catalyst. A small diameter static mixer can be employed at this point to provide thorough mixing of the silyl phosphate with the polymer. An alternate approach can include the use of a mechanically driven in-line mixer at this point to eliminate the pressure drop of a small static mixer. The flow rate of silyl phosphate can be controlled so that the equivalent of approximately one mole equivalent of phosphoric acid is added for every mole equivalent potassium hydroxide in the polymer. The polymer containing silyl phosphate neutralizer can then enter a larger diameter static mixer which provides additional residence under plug flow conditions for completion of the reaction between the potassium silanolate catalyst and the silyl phosphate neutralizer. The neutralized polymer can then be discharged through a back-pressure regulating valve that controls the system pressure.

The neutral polymer can then be devolatilized by passing through a preheater where heating and evaporation take place. The mixed liquid-vapor can then be passed into a vapor-liquid entrainment separator maintained at an absolute pressure of 5 to 10 mm Hg. The devolatized polymer can then be removed from the bottom of the vapor-liquid separator by a pump while the monomer vapors can be removed from the top of the separator, condensed by a water-cooled condenser and pumped out of the evaporator. The monomers, of course, may be collected in a suitable storage tank, or more preferably, recycled to the monomer feedline entering the polymerizer section.

Bond System

The phrase "bond system" is used to describe a material which adheres a plurality of abrasive particles within and to an abrasive article. The bond system can comprise an organic-based binder which can include thermoset resins, thermoplastics, thermoplastic elastomers, and other elastomers materials formed from organic-based binder precursors.

The term "thermoset resin" as used herein refers to a resin which solidifies or crosslinks and sets irreversibly when heated. The term "thermoplastic" as used herein refers to a material which softens and flows upon application of pressure and heat. The term "thermoplastic elastomer" as used herein refers to a reaction product of a low equivalent weight polyfunctional monomer which is capable of polymerizing to form a hard segment and a high equivalent weight polyfunctional monomer capable of polymerizing to produce soft, flexible chains. The term "elastomer" as used herein refers to a substance which stretches under tension, has a high tensile strength, retracts rapidly, and substantially recovers its original dimensions.

Examples of organic-based binder precursors include phenolic and other tar acid resins, urea resins, polyester (unsaturated), epoxy resins, and melamine resins, olefins such as polyethylene and polypropylene, condensation polymers such as polyamides and polyesters, addition polymers such as polyurethanes, free-radical polymerized polymers such as acrylics, radiation polymerized polymers such as multiacrylate and acrylamides, and rubbers such as styrene-butadiene-styrene block copolymers.

For example, if a coated abrasive is being formed, the bond system can be in the form of an abrasive slurry or at least two adhesive layers, the first of which will be referred to hereafter as the "make coat" and the second of which will be referred to as the "size coat." The organic-based binder precursors, for example, resins, which form the bond system of the coated abrasive can include phenolic resins, aminoplast resins having pendant alpha, beta, unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorine modified epoxy resins, and mixtures thereof. Upon exposure to the proper conditions, such as an appropriate energy source, the resin polymerizes to form a cross-linked thermoset polymer or binder.

In addition, if abrasive filaments are being formed, the bond system adhering the abrasive particles is an organic-based binder as described above and, for example, can include thermoplastics, thermoplastic elastomers, and other elastomers.

The bond system of this invention can further comprise optional additives, such as, for example, fillers (including grinding aids), fibers, antistatic agents, lubricants, wetting agents, surfactants, pigments, dyes, coupling agents, plasticizers, and suspending agents. The amounts of these materials can be selected to provide the properties desired.

Examples of useful additives for this invention include calcium carbonate, glass bubbles, glass beads, glass yarns, carbon yarns, potassium tetrafluoroborate, cryolite, carbon powder, and graphite.

Abrasive Particles

Abrasive particles used in abrasive articles of this invention include abrasive grains, abrasive agglomerates comprising a plurality of abrasive grains bonded together by a binder to form a discrete mass, and a combination of abrasive grains and abrasive agglomerates. Useful abrasive particles generally have an average particle size ranging from about 0.1 microns to 1500 microns, preferably 1 to 500 microns, more preferably 5 to 150 microns.

Abrasive particles of this invention may also contain a surface coating. Surface coatings are known to improve the adhesion between the abrasive grain and the binder in the agglomerate and between the agglomerate and the bond system and, therefore, improve the abrading characteristics of the abrasive grains/agglomerates. Suitable surface coatings include those described in U.S. Pat. Nos. 1,910,444; 3,041,156; 5,009,675; 4,997,461; 5,011,508; 5,213,591; and 5,042,991, incorporated herein by reference. For example, diamond and/or CBN may contain a surface treatment, e.g., a metal or metal oxide to improve adhesion to the inorganic binder in the agglomerate. In addition, a coating, such as a thin nickel layer, can be present on the abrasive grain.

Abrasive particles are preferably dispersed throughout and adhered within the bond system. As stated above, abrasive particles useful in the abrasive filaments of the present invention may be individual abrasive grains or agglomerates of individual abrasive particles. Suitable agglomerated abrasive particles are described in U.S. Pat. Nos. 4,652,275and 4,799,939, incorporated by reference herein. The abrasive particles may be of any known abrasive material commonly used in the abrasives art. Preferably, the abrasive particles have a hardness of greater than about 7 Mohs, most preferably greater than about 9 Mohs. Examples of suitable abrasive particles include individual silicon carbide abrasive particles (including refractory coated silicon carbide abrasive particles such as disclosed in U.S. Pat. No. 4,505,720), fused aluminum oxide, heat treated fused aluminum oxide, alumina zirconia (including fused alumina zirconia such as disclosed in U.S. Pat. Nos. 3,781,172; 3,891,408; and 3,893,826, commercially available form the Norton Company of Worcester, Mass., under the trade designation "NorZon"), cubic boron nitride, garnet, pumice, sand, emery, mica, corundum, quartz, diamond, boron carbide, fused alumina, sintered alumina, alpha alumina-based ceramic material (available from Minnesota Mining and Manufacturing Company (3M), St. Paul, Minn., under the trade designation "Cubitron"), such as those disclosed in U.S. Pat. Nos. 4,314,827; 4,518,397; 4,574,003; 4,744,802; 4,770,671; and 4,881,951, and combinations thereof.

Abrasive particles can also be derived from a plastic material, for example, poly(methylmethacrylate), polycarbonate, polyvinyl chloride.

Abrasive particles are present at a weight percent in an abrasive article sufficient to provide the desired abrading characteristics. For illustration, reference is made to abrasive filaments. For example, abrasive particles can be present at a weight percent, based on the weight percent of filament(s) containing the abrasive particles, ranging from about 0.1 to about 60, more preferably ranging from about 25 to about 50.

In order to achieve higher abrasive particle loadings, it may be necessary, depending on the bond system employed, to coat the abrasive particles with a coupling agent prior to introduction into the polymer melt. The coupling agent is preferably used in an amount, based on the weight of the bond system, of 5 percent by weight or less.

Coupling agents found useful and thus preferred for use in this invention are the neopentyl(diallyl)oxy titanates, such as neopentyl(diallyl)oxy,tri(m-amino)phenyl titanate and neopentyl(diallyl)oxy,tri(dioctyl)phosphato titanate. The tri (m-amino)phenyl and tri(dioctyl)phosphato versions are available in pellet form (20 weight percent in TPE) under the trade designations "LICA 97/E" and LICA 12/E", respectively, from Kenrich Petrochemicals, Inc., Bayonne, N.J.

The size of the abrasive particles incorporated into the abrasive filaments of the invention depends on the intended use of the filaments. For applications requiring cutting or rough finishing, larger abrasive particles are preferred, while abrasive particles having smaller size are preferred for finishing applications. For example, in composite abrasive filaments defined herein, preferably, the average diameter of the abrasive particles is no more than about ½ the diameter of the composite abrasive filament, more preferably no more than about ⅓ of the diameter of the composite abrasive filament. In addition, for example, in core-sheath abrasive filaments defined herein when the abrasive particles are in the sheath, preferably, the average diameter of the abrasive particles is no more than about ½ the diameter of the sheath of the abrasive filament, more preferably no more than about ⅓ of the diameter of the sheath of the abrasive filament. Alternatively, when the abrasive particles are in the core, the average diameter of the abrasive particles preferably is no more than the diameter of the core.

Abrasive particles are not required to be uniformly dispersed in the bond system, but a uniform dispersion may, depending on the application, provide more consistent abrasion characteristics.

Abrasive Articles

The abrasive articles of the present invention comprise a bond system as described above, the bond system comprising the polysiloxane described above. Abrasive articles of the present invention include abrasive filaments, abrasive products comprising abrasive filaments, coated abrasives, nonwoven abrasives, bonded abrasives which include molded abrasive wheels, vitrified grinding wheels and the like, and molded abrasive products which include molded abrasive brushes. In order to exemplify the present invention, reference will be made to abrasive filaments comprising a bond system comprising polysiloxane followed by a description of other abrasive articles which may comprise a bond system comprising a polysiloxane of the present invention.

Abrasive Filaments

Abrasive filaments of this invention comprise a bond system, i.e., a hardened organic polymeric material, comprising a plurality of abrasive particles and a polysiloxane as described above. Abrasive filaments typically have a preformed core coated with a bond system comprising a hardened organic polymeric material comprising abrasive grains (a composite abrasive filament) or a core-sheath arrangement in which the core and sheath independently comprise a bond system comprising hardened organic polymeric material and in which at least one of the core and sheath comprise abrasive grains. In addition, an abrasive filament of the present invention can be a monofilament. The term "monofilament" as used herein refers to a single filament of substantially uniform cross-section, the term "substantially" referring to the fact that some variation in cross-section may be present due to the presence of abrasive particles.

As used herein the term "hardened" means rendered resistant to flow and refers to the physical state of an organic polymeric material such as a thermoplastic or thermoplastic elastomeric material when the temperature of the material is below the melting temperature of thermoplastic polymers used herein, and below melting or dissociation temperature of the hard regions (segmented thermoplastic elastomers) or ionic clusters (ionomeric thermoplastic elastomers), as determined through standard tests such as American Society of Testing Materials (ASTM) test D2117. The term can also be used describe the room temperature (i.e. about 10° to about 40° C.) hardness (Shore D scale) in the case of the thermoplastic elastomers used herein. It is preferred that the room temperature Shore D durometer hardness of the thermoplastic elastomers used in the invention be at least about 30, more preferably ranging from about 30 to about 90, as determined by ASTM D790. The term "hardened" does not include physical and/or chemical treatment of the thermoplastic elastomer/abrasive particle mixture to increase its hardness. However, when referring to materials other than thermoplastics and thermoplastic elastomers, the term "hardened" may include physical and/or chemical treatment, for example, heat or ultraviolet radiation, of the material, for example, when a thermoset resin is used.

Composite Abrasive Filament

A composite abrasive filament of this invention comprises at least one preformed core at least partially coated with a hardened organic polymeric material having abrasive particles dispersed and adhered therein and a polysiloxane of the present invention dispersed therein.

As used herein the term "composite abrasive filament" means an abrasive filament having the hardened organic polymeric material described above over at least a portion, preferably over the entire surface of at least one preformed core, where the ratio of the cross-sectional area of the hardened material to that of the preformed core ranges from about 0.5:1 to about 300:1, preferably from about 1:1 to about 10:1, more preferably from about 1:1 to about 3:1, the cross-sections defined by a plane perpendicular to the composite abrasive filament major axis. The composite abrasive filaments can be of any length desired, and can of course be round, oval, square, triangular, rectangular, polygonal, or multilobal (such as trilobal, tetralobal, and the like) in cross-section.

Organic polymeric material of the composite abrasive filaments of the present invention preferably covers the entire preformed core, although this is not a requirement. The organic polymeric material could conceivably cover only that side of the preformed core which strikes the workpiece, and composite abrasive filaments of this construction are considered within the scope of the invention. As would be obvious to skilled artisans, the organic polymeric material need not have the same outer configuration as the core; for example, the organic polymeric material could have a rectangular or triangular cross-section while the preformed core is roughly circular in cross-section. When the organic polymeric material completely coats the preformed core, the ratio of cross-sectional area of the organic polymeric material to the cross-sectional area of the preformed core may vary within a broad range, from about 0.5:1 to about 300:1. More preferably, the ratio of cross-sectional areas ranges from about 1:1 to about 10:1, particularly preferably about 1:1 to about 3:1.

Preformed Core

"Preformed core", as used herein, means one or more core elements which are formed in a step separate from and prior to one or more coating steps, one of which coats the preformed core with abrasive-filled organic polymeric material; in other words, a preformed core is not made simultaneously with the sheath comprising organic polymeric material. The cross-section of the preformed core is not limited as to shape; however, preformed cores having substantially round or rectangular cross-sections have been found suitable.

The composite abrasive filaments may have preformed core and total composite abrasive filament diameters within a broad range, limited only by the size of the apparatus used to coat the preformed core with the molten organic polymeric material, for example, TPE and the article to which the composite abrasive filaments are to be attached. Obviously, as the preformed core diameter of the composite abrasive filament increases, the number of composite abrasive filaments which can be attached to a substrate, such as a hub of a given size, decreases. Preformed core diameters for composite abrasive filaments of the present invention used on typical hand-held tools are preferably at least about 0.1 mm, while the composite abrasive filaments themselves preferably have a diameter ranging from about 1.0 mm to about 2.0 mm. These dimensions could, of course, increase tremendously for a large abrading device, and composite abrasive filaments having much larger preformed core and total diameters are considered within the scope of the appended claims.

Composite abrasive filaments of the invention having a diameter ranging from about 0.75 mm to about 1.5 mm have an ultimate breaking force (which can be measured i.e., using a standard tensile tester known under the trade designation "Instron" Model TM of at least about 2.0 kg, a 50% fatigue failure resistance (i.e., the time required for 50% of the filaments in a given brush to detach from the brush at given conditions as described below for the core-sheath arrangement) of at least about 15 minutes; and an abrasion efficiency (i.e., weight of workpiece removed per weight of filament lost) on ANSI 1018 cold rolled steel plate of at least about 2. As may be seen by the examples herein below, balancing these preferences may be workpiece dependent.

The preformed core preferably extends through the entire length of the filament, but this is not required. It is also not required that the preformed core cross-section have the same shape as the cross-section of the hardened organic polymeric material, and the preformed core and hardened organic polymeric material can be concentric or eccentric, with a single or plurality of core elements being within the invention. For ease of discussion only, the bulk of the disclosure to follow centers on constructions having a single, centrally located preformed core.

The preformed core can be continuous individual metallic wires, a multiplicity of continuous individual metallic wires, a multiplicity of non-metallic continuous filaments, or a mixture of the latter two, provided that the melting temperature of the preformed core is sufficiently high so that a coating of abrasive-filled molten organic polymeric material can be applied to at least a portion of the preformed core, and the molten organic polymeric material cooled rapidly enough to maintain the integrity of the preformed core.

Preferred preformed cores include single and multi-stranded metallic cores, e.g., plain carbon steels, stainless steels, and copper. Other preferred preformed cores include a multiplicity of non-metallic filaments e.g., glass, ceramics, and synthetic organic polymeric materials such as aramid, nylon, polyester, and polyvinyl alcohol.

Preformed core materials useful in the present invention can be envisioned as an abrasive coated substrate that can be selected or modified in its surface characteristics, mechanical properties, and environmental stability properties. The preformed core material is preferably selected or capable of being modified so that its surface has the ability to achieve adhesion between the core and the organic polymeric material. Important mechanical properties include tensile strength and flex fatigue resistance while operating under various chemical, thermal and atmospheric conditions.

Preformed cores useful in the composite abrasive filaments of the present invention include: metal wire such as stainless steel, copper, and the like; inorganic fibers such as glass and ceramic fibers; synthetic fibers, such as aramid, rayon, and the like; natural fibers such as cotton, and mixtures of these. Although continuous monofilaments may be used, preferred cores are stranded, cable and yarn versions of these materials. "Stranded" as used herein refers to twisted together wires while "yarn" refers to twisted together non-metallic monofilaments. Typical arrangements include 1×3, 1×7, 1×19, and 3×7 arrangements, wherein the first number refers to the number of strands or yarns and the second number refers to the number of individual monofilaments or wires twisted together in each yarn or strand. "Cable" refers to two or more strands twisted together, while "plied yarns" refers to two or more yarns twisted together, preferably having the opposite direction of twist compared with the cables (for example, if the cables are twisted together "right handed" the plied yarn may be twisted together "left handed"). Alternatively, the performed core may be in the form of untwisted continuous wires or monofilaments. Preferred yarns include yarns of glass fibers, ceramic fibers, aramid fibers, nylon fibers, polyethylene terephthalate fibers, cotton fibers, plied version thereof, and mixtures thereof.

The diameter of the preformed core is preferably at least about 0.01 mm, more preferably ranging from about 0.1 mm to about 0.7 mm, although there is actually no upper limit to the diameter other than that imposed by currently known methods of making composite abrasive filaments.

Some commercially available preformed core materials useful in the present invention include a 1×7 stranded stainless steel of 0.305 mm outside diameter (OD) available from National Standard, Specialty Wire Division, Niles, Mich.; a continuous glass filament yarn having about 204 monofilaments, known under the order number "ECH 18 1/0 0.5Z 603-0", referred to herein as "OCF H-18", and a similar glass filament yarn having an epoxy silane pretreatment and known under the order number "ECG 75 1/2 2.8 S 603-0" referred to herein as "OCF-G75", both available from Owens-Corning Fiberglass Corporation, Toledo, Ohio; yarns of aramid fibers known under the trade designation "Kevlar" (200–3000 denier, zero twist, type 964) manufactured and sold by E.I. du Pont de Nemours and Company, Inc., Wilmington, Del.; and the plied yarns made of aramid, nylon, and polyester fibers having textile designations #69, #92, and #138 (the numbers referring to the weight of the plied yarn), available from Eddington Thread Manufacturing Company, Bensalem, Pa. or Synthetic Thread Company, Bethlehem, Pa.

In some preferred embodiments the preformed core will be treated with a pretreatment chemical such as an adhesive or sealant, which serves to adhere the organic polymeric material to the preformed core. One group of pretreatment chemicals useful when the preformed core is glass plied yarn are the epoxy-silanes. The preformed core may be abrasive in its own right.

Core-Sheath Arrangement

The core-sheath arrangement preferably includes a first elongate filament component having a continuous surface throughout its length and including a first hardened organic polymeric material. In these embodiments, the abrasive filament preferably further includes a second elongate filament component coterminous with the first elongate filament component, including a second hardened organic polymeric material in melt fusion adherent contact with the first elongate filament component along the continuous surface. The second hardened organic polymeric material can be the same or different than the first hardened organic polymeric material.

At least one of the first and second hardened organic polymeric materials comprises a plurality of abrasive particles adhered therein and at least one of the first and second hardened organic polymeric materials comprises a polysiloxane of the present invention. Notably, a polysiloxane can be present in the first hardened organic polymeric material and abrasive particles can be present in the second hardened organic polymeric material or vice versa or a polysiloxane and abrasive particles can be present together in the same hardened organic polymeric material.

Preferably, a polysiloxane is present in the first hardened organic polymeric material and in the second hardened organic polymeric material.

In embodiments which include first and second elongate filament components, the ratio of the cross-sectional area of the hardened organic polymeric material which includes abrasive particles to the cross-sectional area of the remainder of the filament may vary over a wide range. If the abrasive filament of the invention has a core-sheath structure, and if only one of the core or sheath has abrasive particles therein, the ratio of cross-sectional areas of that part of the filament having abrasive particles to that not having abrasive particles ranges from about 1:1 to about 20:1, preferably from about 1:1 to about 10:1, more preferably from about 1:1 to about 4:1, the cross-sections defined by a plane perpendicular to the abrasive filament major axis. The cross-sectional area of the sheath to that of the abrasive filament is preferably about 40% or greater. The abrasive filaments can be of any length desired, and can of course be round, oval, square, triangular, rectangular, polygonal, or multilobal (such as trilobal, tetralobal, and the like) in cross-section.

For example, an abrasive filament can have a first elongate filament component in the form of core, including a hardened organic polymeric material, abrasive particles, and a polysiloxane. The organic polymeric material of the elongate filament component core has dispersed throughout and adhered therein a plurality of abrasive particles, such as aluminum oxide or silicon carbide abrasive particles, and dispersed throughout a polysiloxane. Alternatively, the first elongate filament component is in the form of a core, formed from a first hardened organic polymeric material, and the sheath is formed of a second hardened organic polymeric material, abrasive particles, and a polysiloxane. In this embodiment, only the sheath includes abrasive particles and a polysiloxane. As described above, in any embodiment, a polysiloxane can be in the same or different organic polymeric material than the abrasive particles.

Another core-sheath abrasive filament embodiment includes having a first and second organic polymeric material, which may be the same or different and each may comprise a blend of organic polymeric material, forming a core and a sheath, wherein both core and sheath include abrasive particles and a polysiloxane, respectively. Abrasive particles may of course be the same or different in terms of type, particle size, particle size distribution, and distribution within the core and sheath, and the same or different polysiloxane may be present within the core and sheath.

Abrasive filaments may have core and total abrasive filament diameters within a broad range, limited only by the size of the apparatus used produce the molten organic polymeric material, and the article to which the abrasive filaments are to be attached. Obviously, as the diameter of the abrasive filament increases, the number of abrasive filaments which can be attached to a substrate, such as a hub of a given size, decreases. Core diameters, for abrasive filaments of the present invention which are core-sheath structures, for abrasive filaments used in typical hand-held tools, are preferably at least about 0.1 mm, while the abrasive filaments themselves preferably have a diameter ranging from about 1.0 mm to about 2.0 mm. These dimensions could, of course, increase tremendously for a large abrading device, and abrasive filaments having much larger core and total diameters are considered within the scope of the appended claims.

Abrasive filaments of the invention having a diameter ranging from about 1.0 mm to about 2.0 mm have an ultimate breaking force (measured using a standard tensile tester at a rate of 10 cm/minute, for example, a tester known under the trade designation "Sintech 2 Tensile Tester") of at least about 0.5 kg (untensilized), preferably at least about 1.0 kg (untensilized); a 50% fatigue failure resistance of at least about 15 minutes (according to a filament flex tester using the test according to the Tynex and Herox Technical Bulletin No. 6, E-19743, Feburary 1978, E.I. Du Pont de Nemours Plastics and Resins Department, Wilmington, Del.); and an abrading efficiency (weight of workpiece removed per weight of filament lost) on an ANSI 1018 cold rolled steel plate of at least about 2.

Monofilament

A monofilament of the present invention comprises an organic polymeric material having abrasive particles dispersed and adhered therein and a polysiloxane of the present invention dispersed therein.

A monofilament has a continuous surface throughout its length and has a cross-sectional area which may vary over a wide range depending on use. The cross-sectional area of a monofilament preferably ranges from 0.1 mm to 5 mm, more preferably from 0.3 to 2. The monofilament may be any desired length and can of course be any shape in cross-section, for example, round, oval, square, triangular, rectangular, polygonal, or multilobal (such as trilobal, tetralobal, and the like).

Abrasive monofilaments of the invention having a diameter ranging from about 1.0 mm to about 2.0 mm have an ultimate breaking force (measured using a standard tensile tester at a rate of 10 cm/minute, for example, a tester known under the trade designation "Sintech 2 Tensile Tester") of at least about 0.5 kg (untensilized), preferably at least about 1.0 kg (untensilized); a 50% fatigue failure resistance of at least about 15 minutes (according to a filament flex tester using the test according to the Tynex and Herox Technical Bulletin No. 6, E-19743, Feb. 1978, E.I. Du Pont de Nemours Plastics and Resins Department, Wilmington, Del.); and an abrading efficiency (weight of workpiece removed per weight of filament lost) on an ANSI 1018 cold rolled steel plate of at least about 2.

Organic Polymeric Material

The organic polymeric material used to form an abrasive filament of the present invention which acts in part as a bond system for abrasive particles and include a polysiloxane of the present invention. Suitable organic polymeric material includes thermoset resins, thermoplastics, thermoplastic elastomers, and other elastomers. A preferable organic polymeric material is a thermoplastic elastomer ("TPE"). For illustration, the discussion of organic polymeric material will refer to a TPE.

Thermoplastic elastomers are defined and reviewed in *Thermoplastic Elastomers, A Comprehensive Review*, edited by N. R. Legge, G. Holden and H. E. Schroeder, Hanser Publishers, New York, 1987 (referred to herein as "Legge et al.", portions of which are incorporated by reference). Thermoplastic elastomers (as defined by Legge et al. and used herein) are generally a reaction product of a low equivalent weight polyfunctional monomer and a high equivalent weight polyfunctional monomer, wherein the low equivalent weight polyfunctional monomer is capable on polymerization of forming hard a segment (and, in conjunction with other hard segments, crystalline hard regions or domains) and the high equivalent weight polyfunctional monomer is capable on polymerization of producing soft, flexible chains connecting the hard regions or domains.

The phrase "thermoplastic elastomer" refers to the class of polymeric substances which combine the processability (when molten) of thermoplastic materials with the functional performance and properties of conventional thermosetting rubbers (when in their non-molten state), and which are described in the art as ionomeric, segmented, or segmented ionomeric thermoplastic elastomers. The segmented versions comprise "hard segments" which associate to form crystalline hard domains connected together by "soft", long, flexible polymeric chains. The hard domain has a melting or disassociation temperature above the melting temperature of the soft polymeric chains.

"Thermoplastic elastomers" differ from "thermoplastics" and "elastomers" (a generic term for substances emulating natural rubber in that they stretch under tension, have a high tensile strength, retract rapidly, and substantially recover their original dimensions) in that thermoplastic elastomers, upon heating above the melting temperature of the hard regions, form a homogeneous melt which can be processed by thermoplastic techniques (unlike elastomers), such as injection molding, extrusion, blow molding, and the like. Subsequent cooling leads again to segregation of hard and soft regions resulting in a material having elastomeric properties, however, which does not occur with thermoplastics.

The general definition of "thermoplastic polymer", or "TP" as used herein, is "a material which softens and flows upon application of pressure and heat." It will of course be realized that TPEs meet the general definition of TP, since TPEs will also flow upon application of pressure and heat. It is thus necessary to be more specific in the definition of "thermoplastic" for the purposes of this invention. "Thermoplastic", as used herein, means a material which flows upon application of pressure and heat, but which does not possess the elastic properties of an elastomer when below its melting temperature. Both materials, however, are within the scope of the present invention. Blends of TPE and thermoplastic (TP) materials are also within the invention, allowing even greater flexibility in tailoring mechanical properties of the abrasive filaments of the invention.

Some commercially available thermoplastic elastomers include segmented polyester thermoplastic elastomers, segmented polyurethane thermoplastic elastomers, segmented polyurethane thermoplastic elastomers blended with other thermoplastic materials, segmented polyamide thermoplastic elastomers, and ionomeric thermoplastic elastomers.

"Segmented thermoplastic elastomer", as used herein, refers to the sub-class of thermoplastic elastomers which are based on polymers which are the reaction product of a high equivalent weight polyfunctional monomer and a low equivalent weight polyfunctional monomer. Segmented thermoplastic elastomers are preferably the condensation reaction product of a high equivalent weight polyfunctional monomer having an average functionality of at least 2 and an equivalent weight of at least about 350, and a low equivalent weight polyfunctional monomer having an average functionality of at least about 2 and an equivalent weight of less than about 300. The high equivalent weight polyfunctional monomer is capable of forming a soft segment upon polymerization, and the low equivalent weight polyfunctional monomer is capable of forming a hard segment upon polymerization. Segmented thermoplastic elastomers useful in the present invention include polyester TPEs, polyurethane TPES, and polyamide TPEs, and silicone elastomer/polyimide block copolymeric TPEs, with the low and high equivalent weight polyfunctional monomers selected appropriately to produce the respective TPE.

The segmented TPEs preferably include "chain extenders", low molecular weight (typically having an equivalent weight less than 300) compounds having from about 2 to 8 active hydrogen functionality, and which are known in the TPE art. Chain extenders are typically used in segmented thermoplastic elastomers to increase the hard segment and hard domain size and thus provide one mechanism to alter the physical properties of the resultant segmented TPE. Chain extenders useful in the segmented TPEs of the present invention preferably have an active hydrogen functionality ranging from about 2 to 8, preferably from about 2 to 4, and more preferably from about 2 to 3, and an equivalent weight less than about 300, more preferably less than about 200. Well suited chain extenders are the linear glycols such as ethylene glycol, 1,4-butanediol, 1,6-hexanediol, and hydroquinone bis(2-hydroxyethyl) ether. Nonlinear diols are normally not suitable as chain extenders for segmented TPEs because the urethanes formed therefrom do not form well defined hard segments and therefore exhibit poor low and high temperature properties. Similarly, although low molecular weight polyfunctional amines including, aromatic, alkyl-aromatic, or alkyl polyfunctional amines, are normally excellent chain extenders, they normally cannot be used in the segmented TPEs of the present invention because the resultant urea groups in the resulting TPE melt well above the useful processing range of the TPE and undergo some degradation on melting. Particularly preferred examples of chain extenders include ethylene diamine and 1,4-butanediol.

Segmented TPEs useful in the composite abrasive filaments of the present invention preferably comprise segmented polyester TPEs, segmented polyurethane TPEs, and segmented polyamide TPEs. The low and high equivalent weight polyfunctional monomers are variously chosen to produce one of the above segmented TPEs. For example, if the TPE comprises a segmented polyester, such as the segmented copoly(etherester)s, the low and high equivalent weight polyfunctional monomers are preferably poly (tetramethylene terephthalate) and poly(tetramethylene oxide), respectively. If the TPE comprises a segmented polyurethane, the low equivalent weight polyfunctional monomer is preferably a polyfunctional isocyanate and the high equivalent weight polyfunctional monomer is preferably a polyfunctional amine.

The weight percent of low equivalent weight polyfunctional monomer in the total weight of monomers which react to produce segmented TPEs preferably ranges from about 20 to about 60 percent, more preferably ranging from about 20 to about 40 percent. Low equivalent weight polyfunctional monomer weight percentages above these ranges generally yield segmented TPEs exhibiting increased hardness, bending modulus, and tensile modulus, accompanied with an increase in glass transition temperature ($T_g$). At weight percentages of low equivalent weight polyfunctional monomer above about 70 weight percent, a phase transition occurs, which leads to a change in the overall behavior from that of a TPE to a more brittle plastic. At weight percentages of low molecular weight polyfunctional monomer below about 20, the TPE behavior more resembles a rubber, and at high filament temperatures, tool operating speeds, and force at which the abrasive article is moved against the workpiece, the composite abrasive filament may tend to "smear". (An industry term of art, "smear" refers to the transfer of portions of the abrasive article to the surface of the workpiece in the case of metal-working applications, or the glazing over of the article's surface in the case of wood-working applications. Smear occurs when heat is generated by frictional rubbing of the abrasive article against a workpiece.) It is believed that the presence of a polysiloxane as described above may contribute to reduction of smear.

TPEs (segmented and ionomeric) useful in composite abrasive filaments of the invention preferably have Shore D durometer hardness values ranging from about 30 to about 90, more preferably ranging from about 50 to about 80, with the hardness of the segmented TPEs governed primarily by the relative equivalent weights and amounts of the low and high equivalent weight polyfunctional monomers, while hardness of ionomeric TPEs is primarily governed by relative amounts of functionalized monomer and olefinic unsaturated monomer.

The mechanical properties of segmented thermoplastic elastomers (such as tensile strength and elongation at break) are dependent upon several factors. The proportion of the hard segments in the polymers which form the TPEs, their chemical composition, their molecular weight distribution, the method of preparation, and the thermal history of the TPE all affect the degree of hard domain formation. Increasing the proportion of the low equivalent weight polyfunctional monomer tends to increase the hardness and the modulus of the resultant TPE while decreasing the ultimate elongation.

The upper use temperature of segmented TPEs is dependent upon the softening or melting point of the low equivalent weight polyfunctional monomer comprising the hard segments. For long term aging, the stability of the high equivalent weight polyfunctional monomer comprising the soft segment is also important. At elevated temperatures and with a lower percentage of hard segments which can contribute to hard domains, bending modulus and tensile strength of the TPE are generally reduced. As may be apparent to those skilled in the plastics processing art, to extend the upper useful temperature of a segmented TPE, it is necessary to introduce low equivalent weight polyfunctional monomers adapted to form hard domains which soften or melt at higher temperatures. However, although increasing the amount of or equivalent weight of low equivalent weight polyfunctional monomers can lead to higher TPE hardness, reduced elastic properties and reduced flex fatigue resistance of the composite abrasive filaments made therefrom may result.

Preferred TPEs having the above properties and which are useful in the invention include those formed from segmented polyesters represented by formula (I)

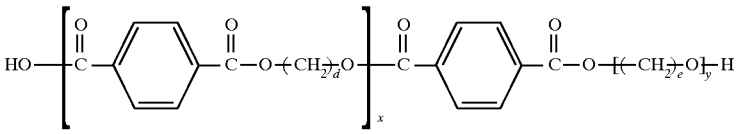

(I)

and mixtures thereof wherein:

d and e are integers each ranging from about 2 to about 6, and wherein d and e may be the same or different; and x and y are integers selected so that the resulting segmented polyester TPE has a Shore D durometer hardness ranging from about 30 to about 90.

Total molecular weight (number average) of segmented polyesters within formula (I) ranges from about 20,000 to about 30,000; x ranges from about 110 to about 125; and y ranges from about 30 to about 115, more preferably from about 5 to about 70.

Commercially available and preferred segmented polyesters represented by formula (I) include those known under the trade designations "Hytrel 4056", "Hytrel 5556", "Hytrel 6356", "Hytrel 7246", and "Hytrel 8238" available from E.I. du Pont de Nemours and Company, Inc., Wilmington, Del., wherein both d and e are 4. Particularly preferred are the versions having Shore D hardness of 63 and 72 ("Hytrel 6356" and "Hytrel 7246", respectively). A similar family of thermoplastic polyesters are available under the tradenames "Riteflex" (Hoechst Celanese Corporation). A still further useful polyester is that known under the trade designation "Ecdel", form Eastman Chemical Products, Inc., Kingsport, Tenn.

Particularly preferred segmented polyamides useful in making segmented polyamide TPEs useful in the invention are those segmented polyamides represented by formula (II):

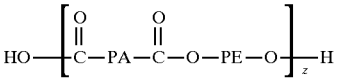

(II)

and mixtures thereof, wherein:

PA=a difunctional polyamide having equivalent weight less than about 300;

PE=a dihydroxypolyether block having equivalent weight of at least 350 and comprising polymers selected from the group consisting of dihydroxypolyoxyethylene, dihydroxypolyoxypropylene, and dihydroxypolyoxytetramethylene; and z=an integer selected to provide the resulting segmented polyamide TPE with a Shore D durometer hardness ranging from about 30 to about 90.

Segmented polyamides within formula (II) are commercially available, such as those known under the trade designation "Pebax", available from Atochem Group of Elf Aquitaine, with the 63 and 70 Shore D durometer versions being particularly preferred in the present invention.

Although values of z are proprietary to the manufacturers, and polymers within formula (II) may be characterized according to hardness, they may alternatively be characterized according to their melt flow rate (as described above), with values ranging from about 1 gm/10 min to about 10 gm/10 min being preferred (ASTM 1238-86, 190/2.16).

Particularly preferred segmented polyurethanes useful in making polyurethane TPEs useful in the invention are those segmented polyurethanes represented by formula (III):

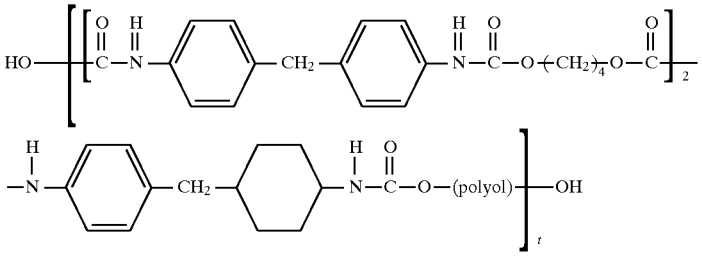

(III)

and mixtures thereof wherein:

polyol=a polyester polyol or polyether polyol having an average molecular weight ranging from about 600 to about 4000; and t=an integer selected to provide the resulting segmented polyurethane TPE with a Shore D durometer hardness ranging from about 30 to about 90.

The value of "t" is chosen relative to the molecular weight of the polyol to give a range of molecular weights; typically and preferably, the number average molecular weight of segmented polyurethanes represented by formula (IV) ranges from about 35,000 to about 45,000.

In general, segmented polyurethanes may be made by mixing the first and second polyfunctional monomers and chain extender together at temperatures above about 80° C. Preferably, the ratio of isocyanate functional groups to isocyanate reactive groups ranges from about 0.96 to about 1.1. Values below about 0.96 result in polymers of insufficient molecular weight, while above about 1.1 thermoplastic processing becomes difficult due to excessive crosslinking reactions.

Segmented polyurethanes within formula (III) which are commercially available and preferred are those known under the trade designation "Estane", available from B.F. Goodrich, Cleveland, Ohio, particularly grades 58409 and 58810. Other segmented preferred segmented polyurethanes include those known under the trade designations "Pellethane", and "Isoplast" from The Dow Chemical Company, Midland, Mich. (Dow Chemical), and those known under the trade designation "Morthane", form Morton Chemical Division, Morton Thiokol, Inc.; and those known under the trade designation "Elastollan", from BASF Corporation, Wyandotte, Mich.

As mentioned previously, blends of TPEs and other polymers have also proven useful, such as the polyurethane/acrylonitrile-butadiene- styrene blends known under the trade designation "Prevail", grades 3050, 3100, and 3150, all from Dow Chemical. Grade 3050 has a melt flow rate (ASTM-1238-86, 230/2.16) of 26 gm/10 min, and a Shore D hardness of about 62.

Block copolymers regarded by those skilled in the plastics processing art as TPEs, including the elastomeric copolymers of silicones and polyimides, may also prove useful in composite abrasive filaments of the invention. Commercially available elastomeric copolymers of thermoplastic silicones and polyimides include those known under the trade designation "Siltem STM-1500", from GE Silicones. These copolymers have a tensile strength of about 25 MPa, elongation of 105%, and flexural modulus of about 415 MPa, according to published values (Design News, May 22, 1989, page 40).

Segmented Polyesters

As noted above, if the TPE is based on a segmented polyester, such as the segmented copoly(etherester) as shown in formula (I), the low and high equivalent weight polyfunctional monomers are preferably based on poly (tetramethylene terephthalate) which forms the hard segment upon polymerization and poly(tetramethylene oxide) which forms the soft segment upon polymerization, respectively. The poly(ether) component of the copoly(etherester) is preferably derived from a-hydro-w-hydroxyoligo (tetramethylene oxide) of number average molecular weight ranging from about 1,000 to about 2,000. The copoly(ester) component of the copoly(etherester) is preferably based on poly(tetramethylene terephthalate) which forms hard segments upon polymerization, having average molecular weights ranging from about 600 to about 3,000. The molecular weight for copoly(etherester) polyesters within formula (I) preferably ranges from about 20,000 to about 40,000. For a more comprehensive discussion of segmented polyesters, see Legge et al. pages 164–196, incorporated by reference herein.

Segmented Polyamides

Polyamides within formula (II) and useful forming segmented polyamide TPEs for use in the invention are typically described as polyether block amides (or "PEBA"), wherein the latter may be obtained by the molten state polycondensation reaction of dihydroxypolyether blocks and dicarboxylic acid-based polyamide blocks as shown in formula (III) (wherein PA represents "polyamide" and PE represents "polyether"). Dicarboxylic polyamide blocks may be produced by the reaction of polyamide precursors with a dicarboxylic acid chain limiter. The reaction is preferably carried out at high temperature (preferably higher than 230° C.) and preferably under pressure (up to 2.5 MPa). The molecular weight of the polyamide block is typically controlled by the amount of chain limiter.

The polyamide precursor can be selected from amino acids such as aminoundecanoic acid and aminododecanoic acid; lactams, such as caprolactam, lauryl lactam, and the like); dicarboxcylic acids (such as adipic acid, azelaic acid, dodecanoic acid, and the like); and diamines (such as hexamethylene diamine, dodecamethylene diamine, and the like).

The dihydroxypolyether blocks may be produced from polyether precursors by either of two different reactions: an ionic polymerization of ethylene oxide and propylene oxide to form dihydroxypolyoxyethylene and dihydroxypolyoxypropylene polyether precursors; and cationic polymerization of tetrahydrofuran for producing dihydroxypolyoxytetramethylene polyether precursors.

The polyether block amides are then produced by block copolymerization of the polyamide precursors and dihydroxypolyether precursors. The block copolymerization is a polyesterification, typically achieved at high temperature (preferably ranging from 230° to 280° C.) under vacuum (10 to 1,400 Pa) and the use of an appropriate catalyst such as $Ti(OR)_4$, where R is a short chain alkyl. It is also generally necessary to introduce additives such as an antioxidant and/or optical brighteners during polymerization.

The structure of the resulting polyether block amides comprises linear, regular chains of rigid polyamide segments and flexible polyether segments. Since polyamide and polyether segments are not miscible polyether block amides such as those represented by formula (III) present a "biphasic" structure wherein each segment offers its own properties to the polymer. Owing to the structure, it is possible to alter four basic chemical criteria to control the physical properties of the polyether block amide: the nature of the polyamide block, the nature of the polyether block, the length of the polyamide blocks and the mass relationship between the polyamide and polyether blocks. The nature of the polyamide block influences the melting point, specific gravity, and chemical resistance of the polyether block amide, while the polyether block influences the glass transition temperature, hydrophilic properties, and anti-static performance. The length of the polyamide block influences the melting point of the polymer, and the mass relationship of the polyamide and polyether blocks controls the hardness properties. For example, it is possible to synthesize grades of polyether block amides having Shore hardness ranging from about 75 D to as low as about 60 A. Increasing polyether content generally reduces tensile strength and elastic nature of the polyether block amides. (See Legge et al., pages 217–230, incorporated by reference herein.)

Segmented Polyurethanes

Segmented polyurethane TPEs useful in the present invention are preferably formed from segmented polyurethanes within formula (III), which are comprised of a high equivalent weight polyfunctional monomer and a low equivalent weight polyfunctional monomer as above described, and may also include a low molecular weight chain extender, also as above described. In thermoplastic polyurethane elastomers, the hard segment is formed by addition of the chain extender, for example, 1,4-butane diol, to a diisocyanate, for example, 4,4'-diphenylmethane diisocyante (MDI). The soft segment consists of long, flexible polyether or polyester polymeric chains which connect two or more hard segments. At room temperature, the low melting soft segments are incompatible with the polar, high melting hard segments, which leads to a microphase separation.

Polyurethanes useful in forming segmented polyurethane TPEs are generally made from long chain polyols having an average molecular weight ranging from about 600 to 4,000 (high equivalent weight polyfunctional monomer), chain extenders with a molecular weight ranging from about 60 to about 400, and polyisocyanates (low equivalent weight polyfunctional monomer). Preferred long chain polyols are the hydroxyl terminated polyesters and the hydroxyl terminated polyethers.

A preferred hydroxyl terminated polyester is made from adipic acid and an excess of a glycol such as ethylene glycol, 1,4-butanediol, 1,6-hexanediol, neopentyl glycol, or mixtures of these diols. The reaction producing the hydroxyl-terminated polyesters from these ingredients is preferably carried out at temperatures up to about 200° C., with the resulting polyester having an acid number of less than about 2, and composed of all possible oligomers ranging from monomeric glycol to high molecular weight species. Other acids which may be used in the production of hydroxyl terminated polyesters include azelaic acid, and terephthalic acid, either alone or in mixture with adipic acid. Generally, the presence of aromatic or cycloaliphatic rings in the acid or in the diol increases the glass transition temperature of the hydroxyl-terminated polyester. Polycaprolactones and aliphatic polycarbonates may be preferable in some applications due to their unique physical properties. The polycaprolactones are preferably made from e-caprolactone and a bifunctional initiator, for example, 1,6-hexanediol. The polycarbonates offer excellent hydrolytic stability and are made from diols, for example, 1,6-hexanediol, and phosgene, or by transesterification with low molecular weight carbonates like dimethyl or diethylcarbonate.

Long chain polyether polyols useful in making polyurethanes within formula (IV) useful in making segmented polyurethane TPEs useful in composite abrasive filaments of the invention are preferably of two classes: the poly (oxypropylene)glycols and the poly(oxytetramethylene) glycols. The former glycols may be made by the base catalyzed addition of propylene oxide and/or ethylene oxide to bifunctional initiators, for example, propylene glycol or water, while the latter may be made by cationic polymerization of tetrahydrofuran. Both of these classes of polyethers have a functionality of about 2. The mixed polyethers of tetrahydrofuran and ethylene or propylene oxide may also be effectively used as the soft segment in the polyurethane TPE.

In contrast to other polyurethanes, only a few polyisocyanates are suitable for producing thermoplastic elastomer polyurethanes. The most useful preferred polyisocyanate is MDI, mentioned above. Others include hexamethylene diisocyanate (HDI), 1-isocyanato-3-isocyanatomethyl-3,5,5-trimethylcyclohexane (IPDI); 2,4 and 2,6-toluene diisocyanate (TDI); 1,4 benzene diisocyanate, and trans-cyclohexane-1,4-diisocyanate.

Ionomeric TPE's

"Ionomeric thermoplastic elastomers" refers to a subclass of thermoplastic elastomers based on ionic polymers (ionomers). Ionomeric TPEs are generally included by those skilled in the plastics processing art in the category of TPEs, and are useful as TPE's in this invention. Ionomeric TPEs are characterized by the formation of ionic clusters between two or more flexible "ionomer" (a word which is a contraction of "ionic polymer") chains, each ionic cluster being analogous to a hard crystalline domain in a TPE comprising segmented polymers. The ionomers, as above described, are the copolymerization product of a functionalized monomer with an olefinic unsaturated monomer. Ionomeric thermoplastic elastomers are composed of two or more flexible polymeric chains bound together at a plurality of positions by ionic associations or clusters. The ionomers are typically prepared by copolymerization of a functionalized monomer with an olefinic unsaturated monomer, or direct functionalization of a preformed polymer. Carboxyl-functionalized ionomers are obtained by direct copolymerization of acrylic or methacrylic acid with ethylene, styrene and similar comonomers by free-radical copolymerization. The resulting copolymer is generally available as the free acid, which can be neutralized to the degree desired with metal hydroxides, metal acetates, and similar salts. A review of ionomer history and patents concerning same is provided in Legge et al., pp. 231–243.

Ionomers useful in forming ionomeric TPEs typically and preferably comprise the reaction product of a functionalized monomer with an olefinic unsaturated monomer, or comprise a polyfunctionalized preformed polymer. Within the terms "ionomeric TPEs" and "ionomers" are included anionomers, cationomers, and zwitterionomers.

Preferred ionomers used to form ionomeric TPEs useful in the invention comprise the copolymerization reaction product of a functionalized monomer and an olefinic unsaturated monomer, the ionomers being represented by formula (IV):

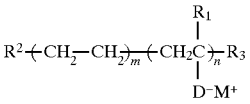

(IV)

and mixtures thereof wherein:

$R^1$, $R^2$, and $R^3$ which may be the same or different and are selected from the group consisting of hydrogen, alkyl, substituted alkyl, aryl, and substituted aryl;

m and n are integers which may be the same or different which are selected so that the weight percentage of the functionalized monomer ranges from about 3 to about 25 weight percent of the total ionomer weight and so that the resulting ionomeric TPE has a Shore D durometer ranging from about 30 to about 90;

D is a functional group selected from the group consisting of COO and $SO_3$,; and M is selected from the group consisting of Na, Zn, K, Li, Mg, Sr, and Pb.

Particularly preferred are those ionomers represented by formula (IV) wherein $R^1$=$R^2$=$R^3$=$CH_3$ and D=COO. A particularly preferred ionomer is when $R^1$=$CH_3$, D=COO, and M=Na, such an ionomer being commercially available, for example, from E.I. du Pont de Nemours and Company, Inc., Wilmington, Del., under the trade designation "Surlyn 8550".

The values of m and n are normally not given by manufacturers but are selected to provide the resulting ionomeric TPE with a room temperature Shore D durometer ranging from about 30 to about 90. Alternatively, m and n may be characterized as providing the molten ionomeric TPE with a flow rate (formerly termed "melt index" in the art) ranging from about 1 gm/10 mins to about 10 gms/10 mins (as per ASTM test D1238-86, condition 190/2.16, formerly D1238-79, condition E). Briefly, the test involves placing a sample within the bore of a vertical, heated cylinder which is fitted with an orifice at the bottom of the bore. A weighted piston is then placed within the cylinder bore, and the amount in grams of molten polymer exiting the cylinder through the orifice is recorded in grams for a 10 minute period.

The functionalized monomer may be selected from acrylic acid, methacrylic acid, vinyl acetate, and the like, and copolymers thereof, with acrylic and methacrylic acid particularly preferred.

The olefinic monomer may be selected from ethylene, propylene, butadiene, styrene, and the like, and copolymers thereof, with ethylene being the olefinic monomer of choice due to its availability and relatively low cost.

The functionalized monomer and olefinic monomer are typically and preferable directly copolymerized using free radicals, such methods being well known in the art and needing no further explanation herein.

Ionomers which may behave as ionomeric TPEs and are therefore useful in the present invention, such as those ionomers known under the trade designation "SURLYN" (which fall within formula (IV)), are preferably prepared by copolymerization of a functionalized monomer and an olefinic unsaturated monomer, or by direct functionalization of a preformed polymer, as previously noted. Ionomers within formula (IV) are particularly preferred for forming ionomeric TPEs for use in hardened materials in composite abrasive filaments of the invention. The large quantities of commercial quality ethylene/methacrylic acid copolymers, for example containing between about 5 and about 20 weight percent methacrylic acid component, makes these ionomers particularly useful in the present invention.

M in formula (IV) is typically and preferably chosen from sodium (Na) and zinc (Zn), although ionomers using potassium (K), lithium (Li), magnesium (Mg), strontium (Sr) and lead (Pb) are considered within the scope of formula (IV).

The use of sodium as the cation in formula (IV) may be desired where water absorption by the ionomeric TPE on the composite abrasive filaments is not a concern, whereas zinc exhibits a much lower water absorption and is thus preferred where water absorption is a concern. Ionomers are preferably neutralized while in the melt, preferably with a metallic reagent added as an oxide, hydroxide or methylate, either dry or as a concentrated solution. As neutralization proceeds, the melt increases in elasticity. Stiffness increases with degree of neutralization, reaching a plateau at about 40% neutralization. However, tensile strength continues to increase at higher levels of neutralization. A preferred degree of neutralization is about 70% to 80% neutralization, since tensile strength of ionomeric TPEs usually plateaus at this point. Neutralization is preferably achieved by the use of metallic acetates, the acetic acid being removed by volatilization. Acetates of zinc, lead, copper, barium, cobalt and nickel all give clear melts and quantitative "cross-linking". A further discussion of ionomers is presented in Legge, et al., pages 231–268, incorporated by reference herein.

The organic polymeric materials are of course not limited to those components. Glass fiber-reinforced polyester thermoplastic elastomers (trade designation "Thermocomp YF") are available from ICI Advanced Materials, LNP Engineering Plastics, Exton, Pa.

The hardened materials comprising thermoplastic elastomer and abrasive particles are of course not limited to those components. Glass fiber-reinforced polyester thermoplastic elastomers (trade designation "Thermocomp YF") are available from ICI Advanced Materials, LNP Engineering Plastics, Exton, Pa.

Method of Making Abrasive Filaments

Exemplary methods of making core-sheath, composite abrasive filaments, and monofilaments in accordance with the present invention are described.

A method of making an abrasive filament of the core-sheath type is described with reference to the use of a thermoplastic elastomer, although other organic polymeric materials can be used, as described above. A method for making a core sheath type abrasive filament can include the steps of (a) rendering a first organic polymeric material comprising a thermoplastic elastomer molten and adding abrasive particles thereto; (b) rendering a second organic polymeric material molten, the second organic polymeric polymer selected from the group consisting of thermoplastic elastomers, thermoplastic polymers, and mixtures thereof; (c) forcing the first and second molten organic materials simultaneously through distinct first and second passages within the same die, the distinct passages forcing the first and second molten organic polymeric materials to assume the shape of first and second elongate filament components in melt fusion adherent contact along a continuous surface of the first component, thus forming an abrasive filament precursor; and (d) cooling the abrasive filament precursor to a temperature sufficient to harden the first and second molten organic polymeric materials and thus form the abrasive filament.

A polysiloxane of the present invention in the form of a concentrate as described above, for example, polysiloxane-containing pellets, can be blended with the thermoplastic elastomer of the first organic polymeric material, the second organic polymeric material, or both prior to rendering the thermoplastic elastomer molten. Alternatively, a polysiloxane of the present invention can be precoated onto a high surface area inorganic filler such as fumed silica and be blended along with the abrasive particles added in step (a).

Preferably, the polysiloxane is added to both the first and second organic polymeric materials.

Preferred are methods wherein the TPE of the first (and second, if a TPE is employed) component is segmented and wherein an extruder is used to render the TPE molten. As used herein the term "molten" means the TPE is heated to a temperature at least above the melting temperature of the soft segment for TPEs, more preferably above the dissociation temperature of the hard regions or ionic clusters of the TPEs, or, when a TP is used, the term "molten" means that the TP is heated above the melting temperature of the TP.

Core-sheath abrasive filaments in accordance with the present invention can be made by an extrusion process, which includes the use of at least two extruders, the outlet of each connected to a die. For example, a first molten, organic polymeric material, comprising TPE or TP and adapted to form one filament component (or blend of TPE and TP) and a second molten organic polymeric material comprising TPE or TP, adapted to form the second elongate filament component, are extruded simultaneously through distinct first and second passages within the same die. The distinct passages force the first and second molten organic polymeric materials to assume the shape of first and second elongate filament components, in melt fusion adherent contact along a continuous surface of the first component, as one or more extrudates from the die.

Abrasive particles, along with optional coupling agents, fillers, pigments, and the like, are added to at least one of the first and second molten organic polymeric materials upstream of the die. One or more abrasive filament precursors are formed from the extrudate(s) by cooling the extrudate(s) (preferably by quenching in a cooling water bath or flowing stream of cooling water) to a temperature sufficient to harden the first and second molten organic polymeric materials. The abrasive filament precursors are then typically wound onto suitable cores by winding machines well-known in the art, where they are held until cut into individual abrasive filaments.

Abrasive particles may also be applied to an abrasive filament precursor extrudate by projecting the abrasive grains toward the extrudate by force, such as electrostatic or mechanical force. Alternatively, the abrasive particles may be applied via a fluidized bed of the abrasive particles wherein the extrudate passes through the fluidized bed. However, the preferred method is wherein the first and second molten organic polymeric materials are passed through a die having abrasive particles already therein, and the extrudate cooled to form the abrasive filament precursors.

In a preferred method in accordance with the invention, a die can be attached to the exit of at least two extruders, an extruder being one preferred technique of rendering the organic polymeric materials molten and mixing the abrasive particles therein. For each TPE the zone temperatures of the extruder and die temperature are preferably set at the temperatures commercially recommended for each TPE (see Table A), the main limitation being the melting or dissociation temperature of the hard domains or ionic clusters of the TPE. Preferred extruder zone and die temperatures are listed in Table A. The extruders (or other melt rendering means, such as heated vessels, and the like) preferably heat the organic polymeric materials above the hard domain or ionic cluster melting or dissociation temperature of the TPE employed (which may have a range that can change with type and grade of the TPE) and the melting temperature of TP employed (which may also have a temperature range) and push molten organic polymeric materials through a heated die.

TABLE A[1]

EXTRUDER ZONE AND DIE TEMPERATURES, °C.

| Extrusion Zone[2] or Die TPE: | 1 | 2 | 3 | 4 | Die |
|---|---|---|---|---|---|
| polyester | 230–250 | 230–250 | 230–250 | 230–250 | 230–250 |
| ionomers | 225–250 | 225–250 | 225–250 | 225–250 | 225–250 |
| polyether block amides | 170–230[3] | 170–230 | 170–230 | 170–230 | 170–230 |
| poly-urethanes | 170–190 | 180–195 | 195–215 | 205–225 | 190–210[4] |

[1]Data from Legge, et al.
[2]"1" corresponds to first heated zone, while "4" refers to the zone preceding the die
[3]Lower temperature for lower hardness, higher temperature for higher hardness grades
[4]Higher temperature near zone 4, lower temperature near outlet of die.

A die which may be used to make core-sheath abrasive filaments of the invention according to the above procedure may include an adapter plate attached via screws to a first stage plate, which is in turn connected to second and third stage plates via bolts. A conduit allows molten organic material to flow into the die from a first extruder and through core passages. A second conduit allows a second molten organic material to flow through passages and thus form sheaths in extrudates. If abrasive filaments of the invention having no sheath are desired, no molten organic material is allowed to enter the die through the conduit. Plugs can be provided to direct flow of molten organic material into tubing inserts having a given internal diameter or shape, which may be easily removed and replaced with other inserts to control the shape and size of the core in core-sheath embodiments. Similarly, other inserts can be provided to control the thickness of the sheath of the extrudates which exit the die from exit ports. If a polysiloxane is added in the form of a concentrate, for example, plastic pellets, the polysiloxane may be added to either or both extruders.

Variations in structural details of dies such as that illustrated may vary. For example, more than two extrudates may be produced from a single die, and a plurality of dies may be employed in a manifold arrangement. For clarity, a die having structure for producing only two extrudates is illustrated in the figures herein. More than two bolts may be provided, as well as more than two screws. Further, the bolts preferably have helicoil type threading elements encasing the bolt shafts to allow high torque to be exerted on the bolts without damage to the stage plates. Also, an "electric blanket" type heating element is typically wrapped around the die to achieve and maintain the desired die temperature.

Abrasive particles and polysiloxane, if, for example, coated on a filler, may be added to the molten organic materials entering through either of the conduits, or both, through feed ports of the extruders, preferably at points early enough to afford adequate dispersal of abrasive particles throughout the molten organic materials but not cause undue abrasion of the metallic parts of the extruders or dies. Alternatively, as noted previously, abrasive particles may be deposited on the molten organic polymeric via a second step (i.e. after forming the extrudate), such as by electrostatic coating.

A cold water quench is located downstream (preferably immediately downstream) of the die through which the extrudate passes to achieve rapid cooling of the molten organic polymeric materials to form an abrasive filament precursor comprising at least one TPE and abrasive particles.

If the abrasive filament precursors are to be oriented, the precursors can be oriented at draw ratios up to about 5:1 to increase the tensile strength of the resulting abrasive filaments of the invention; however, as this appears to noticeably reduce the abrasion efficiency of the abrasive filaments, this is not preferred. After the abrasive filament precursor has hardened, an optional coating (e.g. a plastic coating) may be applied thereover, for aesthetic, storage, or other purposes.

It should further be understood that the abrasive filaments and abrasive particles can contain fillers, lubricants, and grinding aids in levels typically used in the abrasives art.

A method of making a composite abrasive filament is now exemplified with reference to the use of a thermoplastic elastomer although other organic polymeric materials can be used. A method of making a composite abrasive filament can include the steps of (a) rendering a TPE molten and combining abrasive particles therewith; (b) coating at least a portion of a preformed core with a coating comprising the molten thermoplastic elastomer and abrasive particles; and (c) cooling the coating to a temperature sufficient to harden the molten thermoplastic elastomer and thus form the hardened material.

A polysiloxane of the present invention in the form of a concentrate as described above, for example, polysiloxane-containing pellets, can be blended with the thermoplastic elastomer prior to rendering the thermoplastic elastomer molten. Alternatively, a polysiloxane of the present invention can be precoated onto a high surface area inorganic filler such as fumed silica and be blended along with the abrasive particles added in step (a).

Preferred are methods wherein the TPE is segmented, wherein an extruder is used to render the TPE molten, and wherein the preformed core is stranded metallic or stranded non-metallic material. As used herein the term "molten" means the physical state of the TPE when it is heated to a temperature at least above the dissociation temperature of the hard regions or ionic clusters of the TPE under high shear mixing conditions.

Composite abrasive filaments in accordance with the present invention can be made by any of a variety of processes, including passing one or more preformed cores through a die in which molten, abrasive-filled TPE is coated onto the preformed cores as they move through the die, spray coating abrasive-filled, molten TPE onto a preformed core, or by passing a preformed core through a bath of molten TPE, followed by applying abrasive particles to the molten TPE coating. (Alternatively, the abrasive particles could be in the bath of molten TPE.) Abrasive particles may be applied to a TPE-coated core by projecting the abrasive grains toward the TPE-coated preformed core by force, such as electrostatic force. However, the preferred method is the first mentioned one, wherein one or more preformed cores are passed through a die which at least partially coats the preformed cores with molten, abrasive-filled TPE, and the molten TPE cooled to form the hardened material.

In one preferred method in accordance with the invention, a die can be attached to the exit of an extruder, an extruder being one preferred technique of rendering the TPE molten and mixing the abrasive particles into the molten TPE. The apparatus and method of Nungesser et al., U.S. Pat. No. 3,522,342, which is incorporated by reference, is one preferred method. A molten, abrasive-filled TPE (or abrasive-filled TPE/thermoplastic polymer blend, as desired, can be coated on a single preformed core. If a polysiloxane is added in the form of a concentrate, for example, plastic pellets, the polysiloxane may be added to the extruder. The abrasive-filled, polysiloxane-containing TPE-coated preformed core exits the die having a screw attachment for attaching the die to an extruder. Suitable modifications to the die may be made to pass a plurality of preformed cores, these modifications being within the skill of an artisan.

For each TPE the zone temperatures of the extruder and die temperature are preferably set at the temperatures commercially recommended for each TPE (see Table A above), the main limitation being the melting or dissociation temperature of the hard domains or ionic clusters of the TPE. Preferred extruder zone and die temperatures are listed in Table A. The extruder (or other TPE melt rendering means, such as a heated vessel and the like) preferably heats the TPE above the hard domain or ionic cluster melting or dissociation temperature (which may have a range that can change with type and grade of the TPE) and pushes molten TPE through a heated die.

Abrasive particles and polysiloxane, if, for example, coated on a filler, may be added to the molten TPE through a feed port in the extruder into the molten TPE mass, preferably at point early enough to afford adequate dispersal of abrasive particles throughout the molten TPE. Alternatively, abrasive particles may be distributed in the molten TPE coating via a second step (i.e. after the preformed core has been coated with molten TPE), such as by electrostatic coating.

A cold water quench is located immediately downstream of the die through which the molten TPE-coated preformed core passes to achieve rapid cooling of the molten TPE to form a hardened material comprising TPE and abrasive particles on the preformed core prior to windup of the coated preformed core onto a windup roll. A process wherein multiple preformed cores are coated simultaneously may be preferably from the standpoint of mass producing composite abrasive filaments, which may be accomplished using a manifold arrangement. In this case, more than one wind up roll may be required.

Conventional dies may require a pulley mechanism having vertical and horizontal adjustments placed immediately downstream of the cold water quench to provide means for centering the preformed core in the die and provide concentric coatings. Of late, commercially available dies provide this centering function without the use of a separate mechanism. A die known under the trade name "LOVOL", available from Genca Die, Clearwater, Fla., having four helicoid fixed center arrangement, gives acceptable abrasive particle dispersion in the molten TPE, substantially concentric coatings, and is easier to rethread with preformed core material when preformed core material is changed.

The abrasive-filled TPE coating thickness may be changed using mechanical inserts into the die. Thickness of the coating may also be adjusted somewhat by the speed that the preformed core passes through the die, higher speeds yielding somewhat thinner TPE coatings. A preformed core speed of ranging from about 30 to about 100 m/min has proved preferable, more preferably from about 30 to about 45 m/min, for pilot scale operations, while production speeds may be considerably higher, such as 300 m/min in large scale operations.

The hardened, abrasive-filled TPE-coated preformed core may be cut to individual composite abrasive filaments having the desired length. There is no need to orient the filaments to increase their tensile strength prior to use.

Other methods of applying the organic polymeric material to the preformed core to make composite abrasive filaments of the present invention include injection molding, spray coating, and dipping, wherein each case the preformed core is at least partially coated with the molten TPE, and wherein the molten TPE may have abrasive particles dispersed therein or wherein the abrasive particles are applied in a second step, such as electrostatic coating.

After the molten, abrasive-filled TPE has hardened, the composite abrasive filaments may have a coating (e.g. a plastic coating) applied thereover.

It should further be understood that the bond system can contain fillers, lubricants, and grinding aids in levels typically used in the abrasives art.

A monofilament of the present invention can be made as described above with respect to a core of the core-sheath filament, for example, by an extrusion process, whereby the plurality of abrasive particles and a polysiloxane of the present invention are blended together with a molten organic polymeric material to form a filament component, the only distinction being that a second organic polymeric material is not extruded simultaneously as a sheath.

Abrasive Articles Incorporating Abrasive Filaments and Methods of Making and Using An abrasive article incorporating abrasive filaments is preferably comprised of at least one abrasive filament within the invention as described above, preferably mounted to a substrate such as a hub adapted to be rotated at a high rate of revolution. If the article includes more than one abrasive filament, they can be the same or different in composition and shape. Preferred abrasive filaments used in abrasive articles of the invention are application dependent, but core-sheath type filaments including an abrasive-filled polyester TPE and composite abrasive filaments comprising stranded stainless steel wire, glass yarn, and aramid preformed cores, coated with an abrasive-filled polyester TPE have proved useful in abrading many types of workpieces when attached to a rotating hub, while exhibiting greater resistance to flex fatigue and are preferable.

Abrasive filaments of the invention may be incorporated into a wide variety of brushes, either clumped together to form an open, lofty abrasive pad, or attached to various substrates. For example, a wheel brush can be formed having a plurality of abrasive filaments of the invention glued or otherwise attached to a polymeric hub, such methods of attachment being well known in the art. In order to make a polymeric hub, a mold is typically fabricated so that abrasive filaments can be employed in the form of abrasive brushes. A round base plate is fabricated with a 3.18 cm diameter center through hole which is adapted to accept a solid, cylindrical core piece having outer diameter slightly less than 3.18 cm. Slots are machined into one surface of the base plate to create a radial pattern so that thin metal spacers can be inserted therein. The slots extend radially, starting from a point about 5 cm from the center through hole and extending to the periphery of the plate. A right cylinder (200 mm I.D.) may then be fastened to the surface of the base plate having the slots so that the hole in the base plate and the cylinder are concentric. The spacers may then be put in the slots, the solid, cylindrical core piece inserted in the through hole, and a multiplicity of abrasive filaments having length equal to the slot length plus about 5 cm aligned within the spaces left between the spacers. The spacers provide a method to uniformly and closely distribute the abrasive filaments radially with a predetermined length. The abrasive filaments can then be held firmly with a clamp ring, which fits over the end of the filaments pointing toward the center through hole.

A polymeric cast hub is then formed by pouring a liquid epoxy or other resin into the center cavity formed between the solid, cylindrical center core piece and the clamp ring. A useful resin includes a two-part epoxy resin known under the trade designation "DP-420", available from Minnesota Mining and Manufacturing Company, St. Paul, Minn. When the resin is fully cured, the brush may be removed from the device and then tested.

Another method of making abrasive brushes employing the abrasive filaments of the invention is by using a conventional "channel" brushmaking machine, such as that sold under the trade designation "Model Y", available from Carlson Tool and Machine Company, Geneva, Ill.

The abrasive filaments of this invention can be incorporated into brushes of many types and for myriad uses, such as cleaning, deburring, radiusing, imparting decorative finishes onto metal, plastic, and glass substrates, and like uses. Brush types include wheel brushes, cylinder brushes (such as printed circuit cleaning brushes), mini-grinder brushes, floor scrubbing brushes, cup brushes, end brushes, flared cup end brushes, circular flared end cup brushes, coated cup and variable trim end brushes, encapsulated end brushes, pilot bonding brushes, tube brushes of various shapes, coil spring brushes, flue cleaning brushes, chimney and duct brushes, and the like. The filaments in any one brush can of course be the same or different in construction, configuration, length, etc.

Two particularly preferred uses of brushes employing filaments of the invention are printed circuit board cleaning and steel plate cleaning.

Other Abrasive Articles and Methods of Making

Coated Abrasive Article

A coated abrasive typically comprises a backing having a major surface and a bond system, comprising a polysiloxane as described above, the bond system adhering a plurality of abrasive particles to the major surface of the backing and comprising a polysiloxane as described above. The bond system can comprise at least two layers, generally known as a make coat, to which the abrasive particles are applied, and a size coat which is coated over the abrasive particles which can add greater mechanical strength to the abrasive article. The bond system can comprise layers in addition to the make coat and the size coat, for example, a supersize coat, which can be added to provide additional strength or other desired properties. Each of the layers, for example, the make coat and the size coat, comprise a cured binder precursor. Alternatively, the bond system can comprise a slurry comprising a cured binder precursor and the plurality of abrasive particles. The bond system and abrasive particles have been described above.

A polysiloxane of the present invention can be incorporated into the bond system, for example, into an slurry or into an outermost layer, for example, the size coat or the supersize coat, by dispersing or dissolving the polysiloxane into the organic polymeric material making up the bond system, for example, a thermoset resin.

The following description is a preferred but not exclusive method of making a coated abrasive. This preferred method is described with reference to a bond system comprising a make and size coat and a backing comprising a first major surface. If a low stretch backing is used, it can be prepared as described in U.S. Ser. No. 08/199,835 or WO 93/12911. For example, reinforcing fibers or yarns can be laminated to the backside of the polyester cloth belt, as described in U.S. Ser. No. 08/199,835, and can be applied in a continuous manner over the backside of the cloth belt. Generally, the purpose of the reinforcing yarns is to increase the tensile strength and minimize the stretch associated with the backing. Examples of preferred reinforcing yarns include polyaramid fibers, e.g., polyaramid fibers having the trade designation "Kevlar" manufactured by E.I. Du Pont, polyester yarns, glass yarns, polyamide yarns, and combinations thereof. Preferably, splices and joints are not associated with the reinforcing yarns so that the reinforcing yarns serve to strengthen the splice and minimizing splice breakage. Otherwise, any conventional coated abrasive backing can be used.

A make coat comprising a first organic-based binder precursor can be applied to a first major surface of a backing by any suitable technique such as spray coating, roll coating, die coating, powder coating, hot melt coating or knife coating. Abrasive particles can be projected on and adhered in the make coat precursor, i.e., distributed in the make coat precursor. The resulting construction can then be exposed to a first energy source, such as heat, ultra-violet, or electron beam, to at least partially cure the first binder precursor to form a make coat does not flow. For example, the resulting construction can be exposed to heat at a temperature between 50° to 130° C., preferably 80° to 110° C., for a period of time ranging from 30 minutes to 3 hours. Following this, a size coat, into which a polysiloxane of the present invention has been dispersed or dissolved, comprising a second organic-based binder precursor, which may be the same or different from the first organic-based binder precursor, can be applied over the abrasive particles by any conventional technique, for example, by spray coating, roll coating, and curtain coating. Finally, the resulting abrasive construction can be exposed to a second energy source, such as heat, an ultra-violet source, or electron beam, which may be the same or different from the first energy source, to completely cure or polymerize the make coat and the size coat comprising the second binder precursor into thermosetting polymers.

Alternatively, the method may also include applying an abrasive slurry to a first major surface of a backing, where the abrasive slurry comprises a plurality of abrasive particles and a binder precursor, each as described above, and exposing the slurry to conditions which solidify the binder precursor and form an abrasive layer. The conditions can include heating, as described above for curing the make and size coats.

Structured Abrasive

A structured abrasive article typically comprises a backing having a major surface and a plurality of abrasive composites adhered to the major surface of the backing, each abrasive composite comprising a plurality of abrasive particles and a bond system comprising a binder and a polysiloxane as described above. Abrasive composites are shaped, preferably precisely shaped.

The abrasive particles used in abrasive composites of this invention are as described above. Suitable binders include cured binder precursors as described above and, for example, may include acrylate monomer(s), acrylated epoxies, acrylated isocyanates, acrylated isocyanurates, acrylated urethanes, and combinations thereof.

The precisely shaped composites may have the following shapes: pyramids, truncated pyramids, cones, ridges, or truncated cones, preferably pyramids.

A preferred method for making a structured abrasive article comprising abrasive composites generally is described in Assignee's U.S. Pat. No. 5,152,917 (Pieper et al.) and in WO 94/15752 (Spurgeon et al.), both incorporated by reference.

One method for making a structured abrasive article of this invention involves introducing an abrasive slurry comprising a binder precursor, abrasive particles, and a polysiloxane of the present invention (which can be dissolved or dispersed into the binder precursor) onto a production tool, wherein the production tool has a specified pattern.

The binder precursor is then at least partially gelled or cured, before the intermediate article is removed from the outer surface of the production tool, to form a structured coated abrasive article, which is then removed from the production tool.

If the production tool is made from a transparent material, e.g., a polypropylene or polyethylene thermoplastic, then either visible or ultraviolet light can be transmitted through the production tool and into the abrasive slurry to cure the binder precursor. This step is further described in Assignee's U.S. Ser. No. 08/004,929 (Spurgeon).

Alternatively, if the backing is transparent to visible or ultraviolet light, visible or ultraviolet light can be transmitted through the backing to cure the binder precursor.

By at least partially curing or solidifying on the production tool, the abrasive composite has a precise shape and predetermined pattern. However, the production tool can be removed before a precise shape has been achieved resulting in an abrasive composite that does not have a precise shape. The binder precursor can be further solidified or cured off the production tool.

The phrase "production tool" as used herein means an article containing cavities or openings therein. For example, the production tool may be a cylinder, a flexible web, or an endless belt. A backing is introduced onto the outer surface of the production tool after the cavities have been filled so that the abrasive slurry contained in the cavities wets one major surface of the backing to form an intermediate article. The binder precursor is then at least partially cured or gelled, before removing the intermediate article from the outer surface of the production tool. Alternatively, the abrasive slurry can be introduced onto the backing so that the abrasive slurry wets one major surface of the backing to form an intermediate article. The intermediate article is then introduced to a production tool having a specified pattern.

The production tool can be a belt, a sheet, a continuous sheet or web, a coating roll, a sleeve mounted on a coating roll or die. The outer surface of the production tool can be smooth or have a surface topography or pattern. The pattern will generally consist of a plurality of cavities or features. The resulting abrasive particle will have the inverse of the pattern from the production tool. These cavities can have any geometric shape such as a rectangle, semicircle, circle, triangle, square, hexagon, pyramid, octagon, etc. The cavities can be present in a dot-like pattern or continuous rows, or the cavities can butt up against one another.

The production tool can be made from metal or be made from a thermoplastic material. The metal tool can be fabricated by any conventional technique such as engraving, hobbing, electroforming, diamond turning and the like.

The following description outlines a general procedure for making a thermoplastic production tool. A master tool is first provided. If a pattern is desired in the production tool, then the master tool should also have the inverse or the pattern for the production tool. The master tool is preferably made out of metal, e.g., nickel. The metal master tool can be fabricated by any conventional technique such as engraving, hobbing, electroforming, diamond turning, etc. The thermoplastic material is then heated optionally along with the master tool so that the thermoplastic material is embossed with the master tool pattern. After the embossing, the thermoplastic material is cooled to solidify.

Bonded Abrasive

A bonded abrasive of this invention comprises a plurality of abrasive particles and a binder which comprises a polysiloxane as described above and which bonds the plurality of abrasive particles into a shaped mass. The bonded abrasive can be, for example, a conventional flexible bonded abrasive employing an elastomeric polyurethane as the binder. The polyurethane may be a foam as disclosed in U.S. Pat. Nos. 4,613,345; 4,459,779; 2,972,527; and 3,850,589 or a solid as disclosed in U.S. Pat. Nos. 3,982,359; 4,049,396; 4,221,572; 4,933,373; and 5,250,085.

The following description is a preferred but not exclusive method of making a bonded abrasive. A bonded abrasive can be prepared by dispersing a plurality of abrasive particles and dispersing or dissolving a polysiloxane as described above within a binder precursor to form a homogeneous mixture. The mixture can then be molded to the desired shape and dimensions and then subjected to conditions sufficient to cure and solidify the binder precursor, as described, for example, in U.S. Pat. No. 5,250,085.

Nonwoven Abrasive

An abrasive article of this invention can be a nonwoven article which can have at least one major surface and an interior region and comprises an open lofty web of organic fibers, a plurality of abrasive particles, and a binder which comprises a polysiloxane as described above and which adheres the plurality of abrasive particles to the open lofty web. The organic fibers are bonded together at points and the binder precursor comprising the plurality of abrasive particles generally is at least present at the points where the organic fibers are bonded together. Nonwoven abrasives are generally illustrated in U.S. Pat. No. 2,958,593 and can be prepared according to the teachings of U.S. Pat. No. 4,991,362 and U.S. Pat. No. 5,025,596, all of which are incorporated by reference.

In general, nonwoven abrasives include an open, lofty, three-dimensional web of organic fibers bonded together at points where they are contacted by a binder precursor. The binder precursor having a polysiloxane as described above dispersed or dissolved therein can be applied to the web, for example, by roll coating or spray coating, and then subjected to conditions sufficient to cure and solidify the binder precursor. The plurality of abrasive particles can be present in the binder precursor or be applied, for example, by drop coating or electrostatic coating, after the binder precursor is applied but before curing the binder precursor.

Molded Abrasive Brush

An abrasive brush of this invention can be an abrasive brush having a plurality of bristles unitary with the backing, more particularly an abrasive brush made by injection molding a mixture of a moldable polymer and abrasive particles. One aspect presents an integrally molded abrasive brush comprising a flexible base having a first side and a second side, wherein the base is generally planar; and a plurality of flexible bristles extending from the first side of the base. The bristles can have an aspect ratio of at least 2 and are integrally molded with the base. The molded abrasive brush comprises a moldable polymeric material which includes abrasive particles interspersed throughout at least the bristles and which can include a polysiloxane as described above within the moldable polymeric material. In another aspect, the bristles can have an aspect ratio of at least 5 and in yet another aspect, the bristles can have an aspect ratio of at least 7.

An example of method of making a molded abrasive brush can include the steps of: a) mixing a moldable polymer, abrasive particles, and a polysiloxane as described above, for example, in the form of a concentrate, e.g., plastic pellets, together to form a mixture; b) heating the mixture to form a flowable material; and c) injecting the flowable material under pressure into a mold to form an abrasive brush; wherein the brush comprises: a flexible base having a first side and a second side, wherein the base is generally planar; and a plurality of flexible bristles extending from the first side of the base, wherein the bristles have an aspect ratio of at least 2 and are integrally molded with said base. In one aspect of this method, step a) can comprise mixing a thermoplastic elastomer with abrasive particles. In another aspect of method step a) can further comprise mixing a polysiloxane of the present invention with the mixture.

A moldable abrasive brush of the present invention can be as described in copending application Ser. No. 08/431910, entitled, "Molded Abrasive Brush" to Johnson et al. having attorney docket number 51510USA2A, filed on the same date as the present application, which is incorporated by reference.

Method of Abrading a Workpiece

A method of abrading a workpiece with an abrasive article of this invention includes creating relative movement between a workpiece and the abrasive article so that the abrasive article contacts and abrades the workpiece. If an abrasive filament is the abrasive article, the abrasive filament(s) may be attached to a substrate prior to abrading a workpiece. Preferred substrates are metallic hubs, synthetic floor pads, wood, wood-like materials, and plastic. Alternatively, the filaments may be formed into a lofty, open mat, and the mat and/or workpiece moved against each other with pressure, or a single abrasive filament can be used to finish or cut a workpiece.

Various modifications are within the scope of the invention. For example, an abrasive article, in particular, the abrasive articles described herein may comprise a polysiloxane of the present invention over at least a portion of an abrasive surface, i.e., any surface of the abrasive article capable of abrading a workpiece. A polysiloxane of the present invention may be dissolved in a compatible solvent, for example, hexane or heptane, prior to being coated over at least a portion of an abrasive surface of an abrasive article.

EXAMPLES

Flat Plate Abrasion Test

Composite abrasive filament-containing brushes were weighed and separately mounted on a shaft connected to a 2.24 kilowatt (Kw) (3 horsepower (hp)) motor which operated at 1800 rpm. 1018 cold-rolled steel plates, 100 mm square by approximately 6 mm thick, were weighed and then brought in contact with each brush with a force of 13.3 Pa. At 15 minute intervals, the test brushes and steel plates were again weighed to determine the weight loss of the steel plates and weight loss of the test brushes. After 8 test periods of 15 minutes each (120 minutes total) the tests were concluded and the total cut (steel plate weight loss) was calculated. This value was divided by 2 to give average grams cut per hour by each brush. The efficiency (q) of each brush was calculated by dividing the total plate weight loss by the total composite abrasive filament weight loss.

Materials

- Polymer-grade powders available from Witco Organics Division, Perth Amboy, N.J.:
  - stearic acid derivatives: calcium stearate (Ca St), aluminum stearate (Al St), lithium stearate (Li St), zinc stearate (Zn St), and
  - ethyl-bis-stearamide (Et St)
- Molybdenum disulfide (MoS): available from Dow Corning, Midland, Mich., under the trade designation "MOLYKOTE Z Powder"
- Graphite: technical grade graphite, commercially available from Great Lake Carbon Corporation, Morganton, N.C.
- Polysiloxane: available from Dow Corning Corporation, Midland, Mich., under the trade designation "BY27-010"

Brush Construction

A mold was fabricated so that composite abrasive filaments could be used to form abrasive brushes. A circular base plate was fabricated with a 3.18 cm diameter center through hole which was adapted to accept a solid, cylindrical core piece having outer diameter slightly less than 3.18 cm. Slots were machined into one surface of the base plate to create a radial pattern so that thin metal spacers could be inserted therein. The slots extended radially, starting from a point about 5 cm from the center through hole and extending to the periphery of the plate. A right cylinder (200 mm I.D.) was then fastened to the surface of the base plate having he slots so that the hole in the base plate and the cylinder were concentric. The spacers were then put in the slots, the solid, cylindrical core piece inserted in the through hole, and a multiplicity of composite abrasive filaments having length equal to the slot length plus about 5 cm were then aligned within the spaces left between the spacers. The spacers provided a method to uniformly and closely distribute the composite abrasive filaments radially with a predetermined length which could then be held firmly with a clamp ring, which fitted over the end of the filaments pointing toward the center through hole.

A polymeric cast hub was then formed by pouring a liquid, two-part epoxy resin (trade designation "DP-420", from Minnesota Mining and Manufacturing Company, St. Paul, Minn.) into the center cavity formed between the solid, cylindrical center core piece and the clamp ring, at about 50° C. When the resin was fully cured, the brush was removed from the device and then tested.

Example 1

Example 1 demonstrates the comparative efficacy of various components at various levels when included into a composite abrasive filament composition.

A component, as indicated in Table 1, was added at levels of 1%, 2% and 4% to an extrudate of "Hytrel 6356" polyester elastomer while being processed through a 30 mm co-rotating twin-screw extruder with an L:D ratio of 30:1 (available from Werner & Pfleiderer, Ramsey, N.J., as model ZSK30). The polyester elastomer was blended with the component and rendered molten by the extruder (operating at 260–265 rpm with barrel heating set to provide a melt temperature of about 282° C.), whereupon 45 parts of grade 180 silicon carbide abrasive particles per each 55 parts polyester elastomer were added through a feed port of the extruder barrel.

A plied glass preformed core material (available from Owens-Corning Fiberglass Corporation, Toledo, Ohio, under the trade designation "OCF G75 PY") was pulled through an extrusion die which allowed the molten abrasive-containing polyester elastomer to be coated onto the glass preformed core. The extrusion die used was commercially available under the trade designation "LOVOL", from Genca Die, Clearwater, Fla. After exiting the extrusion die, the molten polyester elastomer was hardened by cooling the coated preformed core in a water stream placed about 150 mm from the face of the extrusion die, after which the abrasive-filled, polyester elastomer-coated preformed core was wound onto a separate roll for each component and level combination evaluated. Composite abrasive filaments containing the various levels of components were subsequently cut from each roll, brushes were prepared by the method described above, and the brushes were evaluated by the Flat Plate Abrasion Test. The results are shown in Table 2.

TABLE 1

| Sample Designation | Component | Weight % |
|---|---|---|
| Control 1 | none | 1 |
| Control 2 | " | 2 |
| Control 3 | " | 4 |
| Comparative Sample A | Ca St | 1 |
| Comparative Sample B | " | 2 |
| Comparative Sample C | " | 4 |
| Comparative Sample D | Al St | 1 |
| Comparative Sample E | " | 2 |
| Comparative Sample F | " | 4 |
| Comparative Sample G | Li St | 1 |
| Comparative Sample H | " | 2 |
| Comparative Sample I | " | 4 |
| Comparative Sample J | Zn St | 1 |
| Comparative Sample K | " | 2 |
| Comparative Sample L | " | 4 |
| Comparative Sample M | Et St | 1 |
| Comparative Sample N | " | 2 |
| Comparative Sample O | " | 4 |
| Comparative Sample P | MoS | 1 |
| Comparative Sample Q | " | 2 |
| Comparative Sample R | " | 4 |
| Comparative Sample S | graphite | 1 |
| Comparative Sample T | " | 2 |
| Comparative Sample U | " | 4 |
| Sample A | polysiloxane | 1 |
| Sample B | " | 2 |
| Sample C | " | 4 |

TABLE 2

| Brush Sample Designation | Component | Cut (g/hr) | Wear (g/hr) | Efficiency (cut/wear) |
|---|---|---|---|---|
| Control 1 | none | 1.76 | 0.29 | 6.07 |
| Control 2 | " | 1.76 | 0.29 | 6.07 |
| Control 3 | " | 1.76 | 0.29 | 6.07 |
| Comparative Sample A | Ca St | 1.44 | 0.39 | 3.69 |
| Comparative Sample B | " | 2.06 | 0.58 | 3.55 |
| Comparative Sample C | " | 2.09 | 0.62 | 3.37 |
| Comparative Sample D | Al St | 1.79 | 0.28 | 6.39 |
| Comparative Sample E | " | 1.68 | 0.28 | 6.00 |
| Comparative Sample F | " | 2.63 | 0.57 | 4.61 |
| Comparative Sample G | Li St | 1.72 | 0.64 | 2.69 |
| Comparative Sample H | " | 1.77 | 0.43 | 4.12 |
| Comparative Sample I | " | 2.33 | 0.61 | 3.82 |
| Comparative Sample J | Zn St | 1.81 | 0.50 | 3.62 |
| Comparative Sample K | " | 1.71 | 0.62 | 2.76 |
| Comparative Sample L | " | 1.60 | 0.68 | 2.35 |
| Comparative Sample M | Et St | 2.29 | 0.63 | 3.63 |
| Comparative Sample N | " | 2.29 | 0.60 | 3.82 |
| Comparative Sample O | " | 2.05 | 0.67 | 3.06 |
| Comparative Sample P | MoS | 1.44 | 0.27 | 5.33 |

TABLE 2-continued

| Brush Sample Designation | Component | Cut (g/hr) | Wear (g/hr) | Efficiency (cut/wear) |
|---|---|---|---|---|
| Comparative Sample Q | " | 1.28 | 0.20 | 6.40 |
| Comparative Sample R | " | 2.30 | 0.53 | 4.34 |
| Comparative Sample S | graphite | — | — | — |
| Comparative Sample T | " | 2.46 | 0.41 | 6.00 |
| Comparative Sample U | " | 1.62 | 0.44 | 3.68 |
| Sample A | polysiloxane | 2.37 | 0.45 | 5.27 |
| Sample B | " | 2.14 | 0.09 | 23.78 |
| Sample C | " | 2.42 | 0.07 | 34.57 |

While the wear values decreased in the examples representative of the present invention, the cut values were maintained or increased, resulting in excellent efficiency results, in some cases which were 5 to 6 times higher than the efficiency results of the comparative examples.

Example 2

Example 2 demonstrates the effects of higher polysiloxane additions to the abrasive articles.

The filaments and brushes of Example 2 were prepared identically to those of Example 1, with the exception that even higher levels of the polysiloxane were added and that 45 parts grade P120 aluminum oxide abrasive particles was substituted for the silicon carbide abrasive particles. The Flat Plate Abrasion Test results are shown in Table 3. Note that not only was the brush wear dramatically reduced, but that the cut improved markedly. Overall efficiencies of nearly 30 times the control sample was achieved at the 6% level.

TABLE 3

| Brush Sample Designation | Weight % Polysiloxane | Cut (g/hr) | Wear (g/hr) | Efficiency (g/hr) |
|---|---|---|---|---|
| Comparative Sample V | 0 | 2.85 | 0.28 | 10.18 |
| Sample D | 6 | 3.00 | 0.01 | 300.00 |
| Sample E | 8 | 4.35 | 0.02 | 217.50 |
| Sample F | 10 | 3.15 | 0.04 | 78.75 |

What is claimed is:

1. An abrasive article comprising (a) a plurality of abrasive particles and (b) a bond system which adheres the plurality of abrasive particles, the bond system comprising a binder and a polysiloxane of formula (A):

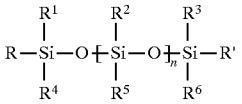

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

2. A coated abrasive comprising (a) a backing having a major surface (b) a plurality of abrasive particles (c) a bond system which adheres the plurality of abrasive particles to the major surface of the backing, the bond system comprising a binder and a polysiloxane of formula (A):

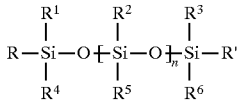

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

3. A bonded abrasive article comprising (a) a plurality of abrasive particles and (b) a bond system which bonds the plurality of abrasive particles into a shaped mass, the bond system comprising a binder and a polysiloxane of formula (A):

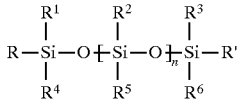

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

4. A nonwoven abrasive article having at least one major surface and an interior region, the nonwoven abrasive article comprising (a) an open lofty web of organic fibers (b) a plurality of abrasive particles (c) a bond system which adheres the plurality of abrasive particles to the open lofty web, the bond system comprising a binder and a polysiloxane of formula (A):

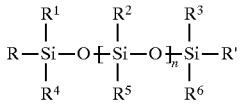

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

5. An abrasive filament comprising:

(a) a first elongate filament component having a continuous surface throughout its length and being comprised of a first hardened organic polymeric material; and (b) a second elongate filament component coterminous with the first elongate filament component comprised of a second hardened organic polymeric material in melt fusion adherent contact with the first elongate filament component along the continuous surface, the second hardened organic polymeric material being the same or different than the first hardened organic polymeric material, wherein at least one of the first and second hardened organic polymeric materials comprises abrasive particles dispersed and adhered therein and at least one of the first and second hardened organic polymeric materials comprises a polysiloxane of formula (A):

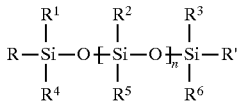

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

6. An abrasive filament in accordance with claim 5 wherein the polysiloxane is a polydimethylsiloxane of formula (B):

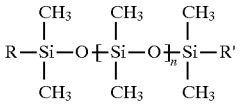

(B)

wherein R and R' may be the same or different and can be an alkyl, vinyl, chloroalkyl, aminoalkyl, epoxy, fluororalkyl, chloro, fluoro, or hydroxy, and n is 500 or greater.

7. An abrasive filament in accordance with claim 5 wherein at least one of the first and second hardened organic polymeric materials comprises a thermoplastic elastomer.

8. An abrasive filament in accordance with claim 7 wherein the thermoplastic elastomer is selected from the group consisting of segmented thermoplastic elastomers, ionomeric thermoplastic elastomers, and blends of segmented thermoplastic elastomers and thermoplastic polymers.

9. An abrasive filament in accordance with claim 8 wherein the segmented thermoplastic elastomer is selected from the group consisting of segmented polyesters, segmented polyurethanes, segmented polyamides, and mixtures thereof.

10. An abrasive filament in accordance with claim 5 wherein the abrasive particles are selected from the group consisting of individual abrasive grains, agglomerates of individual abrasive grains, and mixtures thereof.

11. An abrasive filament in accordance with claim 10 wherein the individual abrasive grains are selected from the group consisting of silicon carbide, aluminum oxide, alumina zirconia, cubic boron nitride, garnet, pumice, sand, emery, mica, quartz, diamond, boron carbide, alpha alumina-based ceramic material, and combinations thereof.

12. An abrasive filament in accordance with claim 10, wherein the abrasive particles are selected from the group consisting of fused aluminum oxide, silicon carbide, alpha alumina-based ceramic material, and the abrasive particles are present in the thermoplastic elastomer at a weight percentage ranging from about 0.1 to about 65 weight percent based on weight of the thermoplastic elastomer.

13. An abrasive filament in accordance with claim 5, wherein the first elongate filament component is a core having a core cross-sectional area, and the second elongate filament component is a sheath having a sheath cross-sectional area, the cross-sectional area of the sheath and the cross-sectional area of the core being defined by a plane perpendicular to a major axis of the abrasive filament.

14. An abrasive filament in accordance with claim 13, wherein only one of the core or sheath has abrasive particles therein, and the ratio of the cross-sectional area of the sheath to the cross-sectional area of the core ranges from about 1:1 to about 20:1.

15. An abrasive filament in accordance with claim 5 wherein at least one of the first and second organic polymeric materials further includes a coupling agent.

16. An abrasive filament in accordance with claim 15 wherein the coupling agent is a titanate.

17. An abrasive filament in accordance with claim 7, wherein the thermoplastic elastomer has a Shore D durometer hardness ranging from about 30 to about 90.

18. An abrasive filament in accordance with claim 13, wherein the abrasive filament has a cross-sectional area defined by a plane perpendicular to a major axis of the abrasive filament and the cross-sectional area of the sheath is 40% or more of the cross-sectional area of the abrasive filament.

19. An abrasive filament in accordance with claim 5 wherein the polysiloxane is present at a weight percent, based on a weight percent of the first and second organic polymeric materials, ranging from at least about 1%.

20. An abrasive filament in accordance with claim 5 wherein the polysiloxane is present at a weight percent, based on a weight percent of the first and second organic polymeric materials, ranging from at least about 2 to 10%.

21. A composite abrasive filament comprising at least one preformed core at least partially coated with a hardened organic polymeric material comprising (a) abrasive particles, the abrasive particles dispersed and adhered in the hardened organic polymeric material, and (b) a polysiloxane of formula (A):

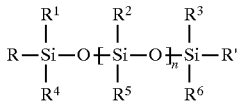

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

22. A composite abrasive filament in accordance with claim 21 wherein the polysiloxane is a polydimethylsiloxane of formula (B):

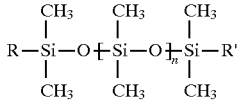

(B)

wherein R and R' may be the same or different and can be an alkyl, vinyl, chloroalkyl, aminoalkyl, epoxy, fluororalkyl, chloro, fluoro, or hydroxy, and n is 500 or greater.

23. A composite abrasive filament in accordance with claim 21 wherein the preformed core is at least one wire or fiber, said preformed core is selected from the group consisting of metal wire, natural fiber, organic synthetic fiber, inorganic synthetic fiber, and combinations thereof and wherein the inorganic synthetic fiber is selected from the group consisting of glass fiber and ceramic fiber.

24. A composite abrasive filament in accordance with claim 21 wherein the hardened organic polymeric material comprises a thermoplastic elastomer.

25. A composite abrasive filament in accordance with claim 24 wherein the thermoplastic elastomer is selected from the group consisting of segmented thermoplastic elastomers, ionomeric thermoplastic elastomers, blends of thermoplastic elastomers and thermoplastic polymers, and mixtures thereof.

26. A composite abrasive filament in accordance with claim 25 wherein the segmented thermoplastic elastomers comprise polymers selected from the group consisting of segmented polyesters, segmented polyurethanes, segmented polyamides, and mixtures thereof.

27. A composite abrasive filament in accordance with claim 21 wherein the abrasive particles are selected from the group consisting of individual abrasive grains, and agglomerates of individual abrasive grains, and mixtures thereof.

28. A composite abrasive filament in accordance with claim 27 wherein the individual abrasive grains are selected from the group consisting of silicon carbide, fused aluminum oxide, alumina zirconia, cubic boron nitride, garnet, pumice, sand, emery, mica, quartz, diamond, boron carbide, alpha alumina-based ceramic material, and combinations thereof.

29. A composite abrasive filament in accordance with claim 27, wherein the abrasive grains are selected from the group consisting of fused aluminum oxide, silicon carbide, and alpha alumina-based ceramic material, and comprise from about 01. to about 65 weight percent of the hardened material.

30. A composite abrasive filament in accordance with claim 23, wherein the preformed core is selected from the group consisting of 1×3, 1×7, and 1×19 stranded metal wire, the preformed core having a diameter of at least about 0.01 mm.

31. A composite abrasive filament in accordance with claim 24, wherein the thermoplastic elastomer has a Shore D durometer hardness ranging from about 30 to about 90.

32. A composite abrasive filament in accordance with claim 21, wherein the composite abrasive filament has a diameter ranging from about 0.75 mm to about 1.5 mm and an ultimate breaking force of at least about 2.0 kg.

33. A composite abrasive filament in accordance with claim 21, wherein the hardened material has a cross-sectional area and the preformed core has a cross-sectional area and the ratio of the cross-sectional area of the hardened material to the cross-sectional area of the preformed core ranges from about 0.5:1 to about 300:1, the cross-sectional areas defined by a plane perpendicular to a major axis of the composite abrasive filament.

34. A composite abrasive filament in accordance with claim 21, wherein the hardened material and the composite abrasive filament each have a cross-sectional area and the cross-sectional area of the hardened material is at least 40% of the cross-sectional area of the composite abrasive filament, the cross-sectional areas defined by a plane perpendicular to a major axis of the composite abrasive filament.

35. A composite abrasive filament in accordance with claim 21, wherein the preformed core comprises at least one continuous monofilament having a diameter of at least about 0.2 mm.

36. A composite abrasive filament in accordance with claim 21, wherein the preformed core comprises a plurality of substantially parallel wires or fibers, said preformed core is selected from the group consisting of metal wire, inorganic synthetic fibers, natural fibers, organic synthetic fibers, and combinations thereof.

37. A composite abrasive filament in accordance with claim 36, wherein the metal is selected from the group consisting of stainless steels, plain carbon steels, copper, and combinations thereof.

38. A composite abrasive filament in accordance with claim 21 wherein the polysiloxane is present at a weight percent, based on a weight percent of the organic polymeric material, ranging from at least about 1%.

39. A composite abrasive filament in accordance with claim 21 wherein the polysiloxane is present at a weight percent, based on a weight percent of the organic polymeric material, ranging from at least about 2 to 10%.

40. A structured abrasive article comprising a backing having a major surface and a plurality of abrasive composites adhered to the major surface of the backing, each abrasive composite comprising a plurality of abrasive particles and a bond system comprising a binder and a polysiloxane of formula (A):

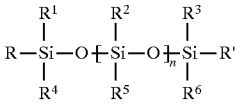

(A)

wherein R, R', $R^1$, $R^2$, $R^3$, $R^4$, $R^5$, and $R^6$ may be the same or different and can be an alkyl, vinyl, chloroalkyl, aminoalkyl, epoxy, fluororalkyl, chloro, fluoro, or hydroxy, and n is 500 or greater.

41. A monofilament comprising a hardened organic polymeric material, a plurality of abrasive particles, and a polysiloxane of formula (A):

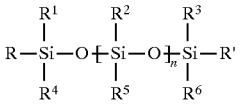

(A)

wherein R, R', $R^1$, $R^2$, $R^3$, $R^4$, $R^5$, and $R^6$may be the same or different and can be an alkyl, vinyl, chloroalkyl, aminoalkyl, epoxy, fluororalkyl, chloro, fluoro, or hydroxy, and n is 500 or greater.

* * * * *